US006925271B2

(12) United States Patent
Suzuki et al.

(10) Patent No.: US 6,925,271 B2
(45) Date of Patent: Aug. 2, 2005

(54) IMAGE FORMING APPARATUS AND FIXING APPARATUS

(75) Inventors: Masahiro Suzuki, Shizuoka (JP); Akihiko Takeuchi, Shizuoka (JP); Atsuyoshi Abe, Shizuoka (JP); Tomonori Shida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/241,583

(22) Filed: Sep. 12, 2002

(65) Prior Publication Data

US 2003/0053814 A1 Mar. 20, 2003

(30) Foreign Application Priority Data

Sep. 14, 2001 (JP) ..... 2001/279825

(51) Int. Cl.[7] ..... G03G 15/20
(52) U.S. Cl. ..... 399/69
(58) Field of Search ..... 399/37, 67, 69, 399/70, 88, 320, 328, 329, 330, 335; 347/156; 219/216

(56) References Cited

U.S. PATENT DOCUMENTS 5,177,549 A 1/1993 Ohtsuka et al.
5,331,385 A 7/1994 Ohtsuka et al.
5,426,494 A * 6/1995 Muto et al. ..... 399/335
5,444,521 A * 8/1995 Tomoyuki et al. ..... 399/69
5,517,284 A 5/1996 Ohtake et al.

(Continued)

FOREIGN PATENT DOCUMENTS

| | | |
|---|---|---|
| EP | 0 301 544 | 2/1989 |
| EP | 0 546 545 | 6/1993 |
| JP | 51-109739 | 9/1976 |

*Primary Examiner*—Sandra L. Brase
(74) *Attorney, Agent, or Firm*—Fitzpatrick, Cella, Harper & Scinto

(57) ABSTRACT

An image forming apparatus has image forming means for forming an unfixed toner image on a recording material, heating and fixing means for heating and fixing the unfixed toner image on the recording material, temperature sensing means for sensing the temperature of the heating and fixing means, and power controlling means for controlling power supplied to the heating and fixing means so that the heating and fixing means keeps a fixable temperature at least on fixing operation based on an output from the temperature sensing means. The power controlling means controls power supply to the heating and fixing means based on the output from the temperature sensing element during the time from receipt of a print signal by the image forming apparatus to performing a heating and fixing process on the recording material so that, in the case where the temperature of the heating and fixing means rises fast, a temperature control operation for keeping the fixable temperature should not be protracted before heating and fixing so as to control excessive rise in the temperature of the pressure member (pressure roller) and prevent a media slip.

59 Claims, 19 Drawing Sheets

U.S. PATENT DOCUMENTS

| | | | | | |
|---|---|---|---|---|---|
| 5,534,987 | A | | 7/1996 | Ohtsuka et al. | |
| 5,543,904 | A | | 8/1996 | Kato et al. | |
| 5,552,582 | A | | 9/1996 | Abe et al. | 219/619 |
| 5,552,874 | A | | 9/1996 | Ohtsuka et al. | |
| 5,745,833 | A | | 4/1998 | Abe et al. | 399/330 |
| 5,758,228 | A | | 5/1998 | Hirose et al. | 399/70 |
| 5,768,654 | A | * | 6/1998 | Noguchi et al. | 399/69 |
| 5,819,150 | A | | 10/1998 | Hayasaki et al. | 399/330 |
| 5,847,361 | A | * | 12/1998 | Yonekawa et al. | 219/216 |
| 5,852,763 | A | | 12/1998 | Okuda et al. | 399/329 |
| 5,881,349 | A | | 3/1999 | Nanataki et al. | 399/328 |
| 5,940,655 | A | | 8/1999 | Sano et al. | 399/69 |
| 5,966,577 | A | | 10/1999 | Abe | 399/320 |
| 5,970,299 | A | | 10/1999 | Sano et al. | 399/330 |
| 5,999,787 | A | * | 12/1999 | Finsterwalder et al. | 399/329 |
| 6,031,215 | A | | 2/2000 | Nanataki et al. | 219/619 |
| 6,049,691 | A | | 4/2000 | Abe et al. | 399/330 |
| 6,072,964 | A | | 6/2000 | Abe et al. | 399/69 |
| 6,078,780 | A | | 6/2000 | Abe et al. | 399/328 |
| 6,088,567 | A | | 7/2000 | Miyashiro et al. | 399/400 |
| 6,097,919 | A | | 8/2000 | Takeuchi et al. | 399/298 |
| 6,151,477 | A | | 11/2000 | Takeuchi et al. | 399/318 |
| 6,343,195 | B1 | | 1/2002 | Abe et al. | 399/69 |
| 6,383,628 | B2 | | 5/2002 | Abe et al. | 428/334 |

* cited by examiner

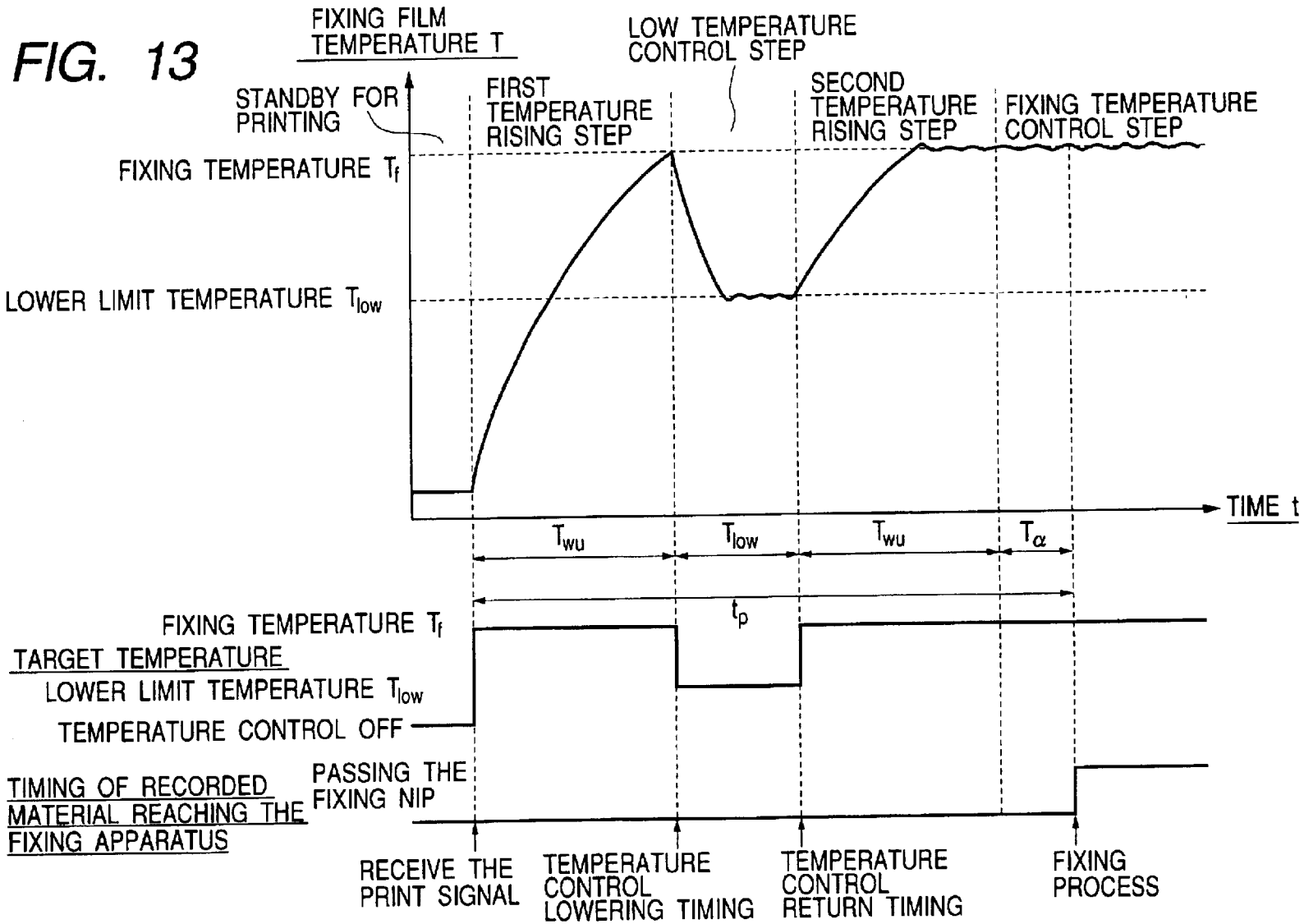
FIG. 13
FIXING FILM TEMPERATURE T
STANDBY FOR PRINTING
FIXING TEMPERATURE $T_f$
LOWER LIMIT TEMPERATURE $T_{low}$
FIRST TEMPERATURE RISING STEP
LOW TEMPERATURE CONTROL STEP
SECOND TEMPERATURE RISING STEP
FIXING TEMPERATURE CONTROL STEP
TIME t
$T_{wu}$
$T_{low}$
$T_{wu}$
$T_\alpha$
$t_p$
FIXING TEMPERATURE $T_f$
TARGET TEMPERATURE
LOWER LIMIT TEMPERATURE $T_{low}$
TEMPERATURE CONTROL OFF
TIMING OF RECORDED MATERIAL REACHING THE FIXING APPARATUS
PASSING THE FIXING NIP
RECEIVE THE PRINT SIGNAL
TEMPERATURE CONTROL LOWERING TIMING
TEMPERATURE CONTROL RETURN TIMING
FIXING PROCESS

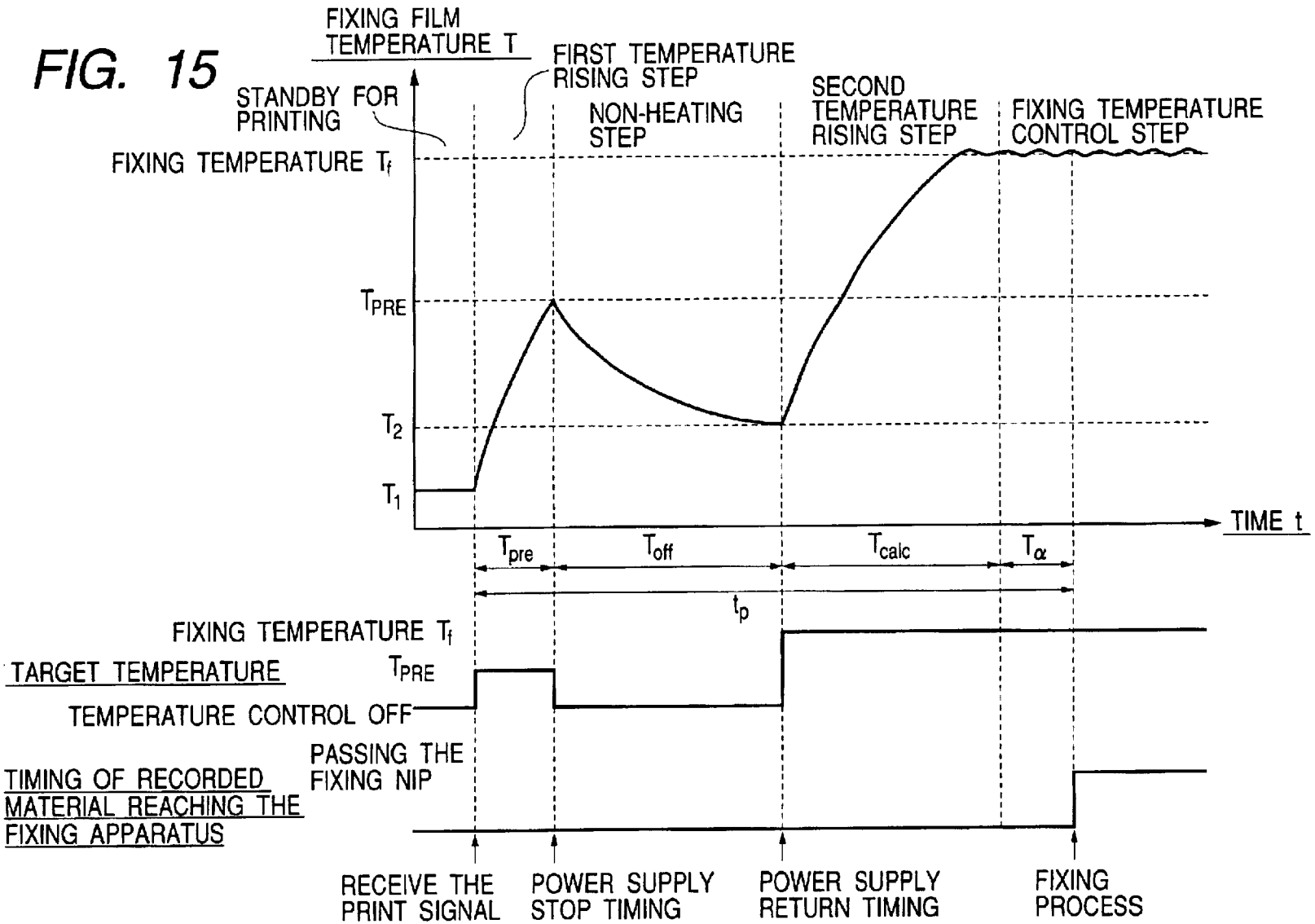
FIG. 15
FIXING FILM TEMPERATURE T
STANDBY FOR PRINTING
FIRST TEMPERATURE RISING STEP
NON-HEATING STEP
SECOND TEMPERATURE RISING STEP
FIXING TEMPERATURE CONTROL STEP
FIXING TEMPERATURE $T_f$
$T_{PRE}$
$T_2$
$T_1$
TIME t
$T_{pre}$
$T_{off}$
$T_{calc}$
$T_\alpha$
$t_p$
FIXING TEMPERATURE $T_f$
TARGET TEMPERATURE
$T_{PRE}$
TEMPERATURE CONTROL OFF
TIMING OF RECORDED MATERIAL REACHING THE FIXING APPARATUS
PASSING THE FIXING NIP
RECEIVE THE PRINT SIGNAL
POWER SUPPLY STOP TIMING
POWER SUPPLY RETURN TIMING
FIXING PROCESS

IMAGE FORMING APPARATUS AND FIXING APPARATUS

BACKGROUND OF THE INVENTION

1. Field of the Invention

The present invention relates to an image forming apparatus and a fixing apparatus provided thereto and, in more particularly, to an apparatus for forming an unfixed toner image on a surface of a recording material by appropriate image forming processing means such as electrophotography, electrostatic recording and magnetic recording including a copier, a printer and a facsimile, using a toner made from a heat melting resin and so on by a direct or indirect method, and heating and fixing it on the surface of the recording material as a permanently fixed image by heating and fixing means.

2. Related Background Art

In an image forming apparatus, a fixing apparatus of a heat-roller method is widely used as a heating means for fixing an unfixed toner image formed on a recording material by an appropriate image forming processing means. The fixing apparatus of the heat-roller method keeps in contact a fixing roller as a heating member incorporating a heat generating means such as a halogen heater and a pressure roller as a pressure member so as to fix the unfixed toner image by applying heat and pressure while transporting the recording material.

In recent years, a fixing apparatus of a film heating method is rendered commercially practical from viewpoints of a quick start and energy conservation. The fixing apparatus of the film heating method is the one wherein a fixing nip is formed by having a heat-resistant thin film sandwiched between a ceramic heater as heat generating means and a pressure roller as a pressure member. It fixes the unfixed toner image by rotating the film and the pressure roller together to apply the heat and pressure while transporting the recording material. The film is heated by the ceramic heater at the fixing nip. The ceramic heater has its temperature sensed by a temperature sensing element provided on the back thereof, and energization to the ceramic heater is controlled and temperature control thereof is performed based on the results of the sensing.

As for the above fixing apparatus of the film heating method, heat capacity of the film as a heating member is very small compared to the heat-roller method, and so it is possible to efficiently use thermal energy from the heat generating means in a fixing process. For this reason, a temperature rising speed of the fixing apparatus is fast so that waiting time between power-up of the apparatus and a printable state thereof can be rendered shorter (quick start). In addition, there is no need to preheat the heating member during standby for printing so that power consumption of the image forming apparatus can be held low (energy conservation).

There is a proposal, as a fixing apparatus of a further high-efficiency film heating method, of the fixing apparatus of the electromagnetic induction heating method for causing a conductive film itself to generate heat. Japanese Utility Model Application Laid-Open No. 51-109739 discloses, as the fixing apparatus of the electromagnetic induction heating method, the fixing apparatus for having an eddy current induced to a metallic film by an alternating magnetic field to cause the metallic film to generate heat with Joule heat. As it is possible to cause the film itself to generate heat by the electromagnetic induction heating method, the thermal energy from the heat generating means can be used further efficiently in the fixing process.

Hereafter, the temperature control of the fixing apparatus on a start of printing will be described.

FIG. 23 is a schematic view showing a fixing film temperature, a target temperature setting and timing of recording material reaching the fixing apparatus when starting the printing in the fixing apparatus of the past fixing apparatus (the fixing apparatus of the film heating method using the ceramic heater or the fixing apparatus of the electromagnetic induction heating method/film heating method).

Although the temperature control is off and no preheating is performed during standby for printing, preheating may also be performed. The image forming apparatus starts an image forming operation after receiving a print signal. The image forming apparatus starts power supply to the fixing apparatus at the same time, and increases the temperature of the fixing apparatus to a fixing temperature $T_f$. And the fixing apparatus keeps the fixing temperature $T_f$ and prepares for fixing of the unfixed toner image on the recording material. The above steps will be collectively called a starting step of the fixing apparatus.

In the starting step of the fixing apparatus, the recording material are not put through paper so that most of the heat from the heat generating means is used to increase the temperature of the pressure roller via a film. In particular, in the case where the fixing apparatus is already warmed up, time $t_{wu}$ for rising to the target temperature is short and time $t_p-t_{wu}$ for keeping the fixing temperature $T_f$ is long, so that the temperature of the pressure roller further rises. For this reason, the temperature of the pressure roller is apt to rise excessively in the case where the starting step is repeated as with intermittent printing.

In the case of fixing the recording material requiring a lot of heat capacity for the fixing such as a cardboard or an OHT film in general, processing speed is reduced. In the stating step in such a case, time $t_p$ from the start of the image forming operation until the recording material reaches the fixing apparatus becomes longer, and so the time $t_p-t_{wu}$ for keeping the recording material at the fixing temperature $T_f$ without putting it through paper becomes longer. For this reason, the temperature of the pressure roller is apt to rise excessively as with the intermittent printing.

As described above, there is a problem that, if the printing is performed in a state in which the temperature of the pressure roller has excessively risen, slipping of the recording material is apt to occur. It is because moisture in the recording material evaporates on the heating and fixing and frictional force between the pressure roller and the recording material is reduced. In particular, the higher the temperature of the pressure roller is, the more the amount of evaporated moisture becomes, and so the slipping of the recording material is more likely to occur. Furthermore, the slipping of the recording material occurs more conspicuously in the case of the fixing apparatus of the film heating method wherein a driving force is applied to the pressure roller and the film is rotated by being slaved to the pressure roller.

There was a problem that, if the slipping of the recording material occurs, the recording material does not move along a carriage guide member or winds itself around the film, resulting in occurrence of a jam. Furthermore, there was a problem that, as it is not possible to stably apply the heat and pressure to the unfixed toner image, quality of a fixed image is lowered.

SUMMARY OF THE INVENTION

An object of the present invention is to solve the above technological problems and control an excessive temperature rise of a pressure roller in a starting step of a fixing apparatus and thereby prevent a recording material from slipping in the fixing apparatus so as to stabilize carriage of the recording material and improve quality of a fixed image.

In order to attain the above object, a heating apparatus and an image forming apparatus according to the present invention are characterized by the following configuration.

(1) The image forming apparatus according to the present invention comprises image forming means for forming an unfixed toner image on the recording material, heating and fixing means for heating and fixing the above described unfixed toner image on the recording material, temperature sensing means for sensing the temperature of the above described heating and fixing means, and power controlling means for controlling power supplied to the above described heating and fixing means so that the above described heating and fixing means keeps a fixable temperature at least on fixing operation based on an output from the above described temperature sensing means, wherein the above described power controlling means controls power supply to the above described heating and fixing means based on the above described output from the temperature sensing element during the time from receipt of a print signal by the image forming apparatus to performing a heating and fixing process on the recording material so that, in the case where the temperature of the above described heating and fixing means rises fast, a temperature control operation for keeping a fixable temperature should not be protracted before heating and fixing.

(2) Preferably, the above described power controlling means performs a low temperature control step for controlling the heating and fixing means at a temperature lower than the fixable temperature or a non-heating step for heating no heating and fixing means during the time from after receipt of the print signal by the image forming apparatus to performing the heating and fixing process so as to control power supply to the heating and fixing means.

(3) Preferably, the temperature of the heating and fixing means is increased more than once by sandwiching the above described low temperature control step or the above described non-heating step during the time from after receipt of the print signal by the image forming apparatus to before performing the heating and fixing process, and at least by a temperature rise lastly performed thereof, it prepares for the heating and fixing process of the recording material by rendering the target temperature as a fixable temperature.

(4) Preferably, the temperature of the heating and fixing means is increased once after receipt of the print signal by the image forming apparatus so as to determine performance time of the above described low temperature control step or the above described non-heating step by this temperature rise behavior.

(5) Preferably, the temperature of the above described heating and fixing means is increased once to the fixable temperature or a lower temperature than that after receipt of the print signal by the image forming apparatus.

(6) Preferably, the above described heating and fixing means is comprised of a rotating heating member capable of rotation and heating the recording material, a rotating pressure member for forming a nip therewith to heat and pressurize the recording material, and heat generating means for increasing the temperature of the above described rotating heating member.

(7) Preferably, the above described rotating heating member is a cylindrical film.

(8) Preferably, the above described rotating heating member is driven by being slaved to the rotating pressure member.

(9) Preferably, the above described rotating heating member has a conductive member, and the heating means for heating the above described rotating heating member is magnetic field generating means including an exciting coil, which has an alternating magnetic field from the above described magnetic field generating means act upon the above described conductive member to generate an eddy current so as to cause the above described rotating heating member to generate heat.

(10) The fixing apparatus according to the present invention for heating and fixing the unfixed toner image on the recording material introduced from the image forming means comprises the temperature sensing means for sensing the temperature of the above described fixing apparatus and the power controlling means for controlling the power supplied to the above described fixing apparatus so that the above described fixing apparatus keeps the fixable temperature at least on fixing operation based on the output from the above described temperature sensing means, wherein the above described power controlling means controls the power supply to the fixing apparatus based on the above described output from the temperature sensing element during the time from after a print start to performing the heating and fixing process on the recording material so that, in the case where the temperature of the above described fixing apparatus rises fast, a temperature control operation for keeping a fixable temperature should not be protracted before the heating and fixing.

(11) Preferably, the above described power controlling means controls the power supply to the fixing apparatus by performing the low temperature control step for controlling the temperature of the fixing apparatus at a temperature lower than the fixable temperature or the non-heating step for heating no heating and fixing means during the time from after receipt of the print signal by the image forming apparatus to performing the heating and fixing process.

(12) Preferably, the temperature of the fixing apparatus is increased more than once by sandwiching the above described low temperature control step or the above described non-heating step during the time from after the receipt of the print signal by the image forming apparatus to before performing the heating and fixing process, and at least by the temperature rise lastly performed thereof, it prepares for the heating and fixing process of the recording material by rendering the target temperature as a fixable temperature.

(13) Preferably, the temperature of the fixing means is increased once after the receipt of the print signal by the image forming means so as to determine performance time of the above described low temperature control step or the above described non-heating step by this temperature rise behavior.

(14) Preferably, the temperature of the above described fixing apparatus is increased once to the fixable temperature or a lower temperature than that after the receipt of the print signal by the image forming apparatus.

(15) Preferably, the fixing apparatus is comprised of the rotating heating member capable of rotation and heating the recording material, the rotating pressure member for forming the nip therewith to heat and pressurize the recording material, and the heat generating means for increasing the temperature of the above described rotating heating member.

(16) Preferably, the above described rotating heating member is the cylindrical film.

(17) Preferably, the above described rotating heating member is driven by being slaved to the rotating pressure member.

(18) Preferably, the above described rotating heating member has the conductive member, and the above described heat generating means is the magnetic field generating means including the exciting coil, which has the alternating magnetic field from the above described magnetic field generating means act upon the above described conductive member to generate the eddy current so as to cause the above described rotating heating member to generate heat.

(19) Preferably, it has a first sequence group for sequentially operating at least following the receipt of the print signal by the image forming apparatus, and a second sequence group for determining timing of starting the operation according to a sensed temperature of the fixing apparatus after a predetermined time from the receipt of the print signal by the image forming apparatus.

(20) Preferably, the above described first sequence group at least includes control related to the temperature control of the heating and fixing means.

(21) Preferably, the above described second sequence group at least includes the control related to rotation of a development roller, the rotation of a photosensitive drum or application of a charging bias.

(22) Preferably, after the above described second sequence group starts the operation, the above described first sequence group operates by rendering criteria of the above described second sequence group as their new criteria.

(23) Preferably, the above described image forming means is a color image forming apparatus for forming an image by performing charging, exposure and development more than once.

According to the present invention, in a temperature starting step of the heating and fixing means (fixing apparatus) on the start of printing, the above described power controlling means controls the power supply to the above described heating and fixing means to control an excessive temperature rise of the pressure member based on the output from the temperature sensing element so that, in the case where the temperature of the above described heating and fixing means rises fast, a temperature control operation for keeping a fixable temperature should not be protracted before the heating and fixing, and the recording material is thereby prevented from slipping.

Accordingly, it is possible to stably carry the recording material on the fixing apparatus. In addition, it is also possible to have energy conservation effects such as reduction in power consumption and a decreased temperature rise in the machine.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 13 is a schematic view showing the temperature control in the starting step of the fixing apparatus according to the second embodiment;

FIG. 15 is a schematic view showing the temperature control in the starting step of the fixing apparatus according to the third embodiment;

DETAILED DESCRIPTION OF THE PREFERRED EMBODIMENTS

Hereafter, embodiments of the present invention will be described.

(First Embodiment)

The first embodiment of the present invention will be described.

(1) Image Forming Apparatus

Figure 1:
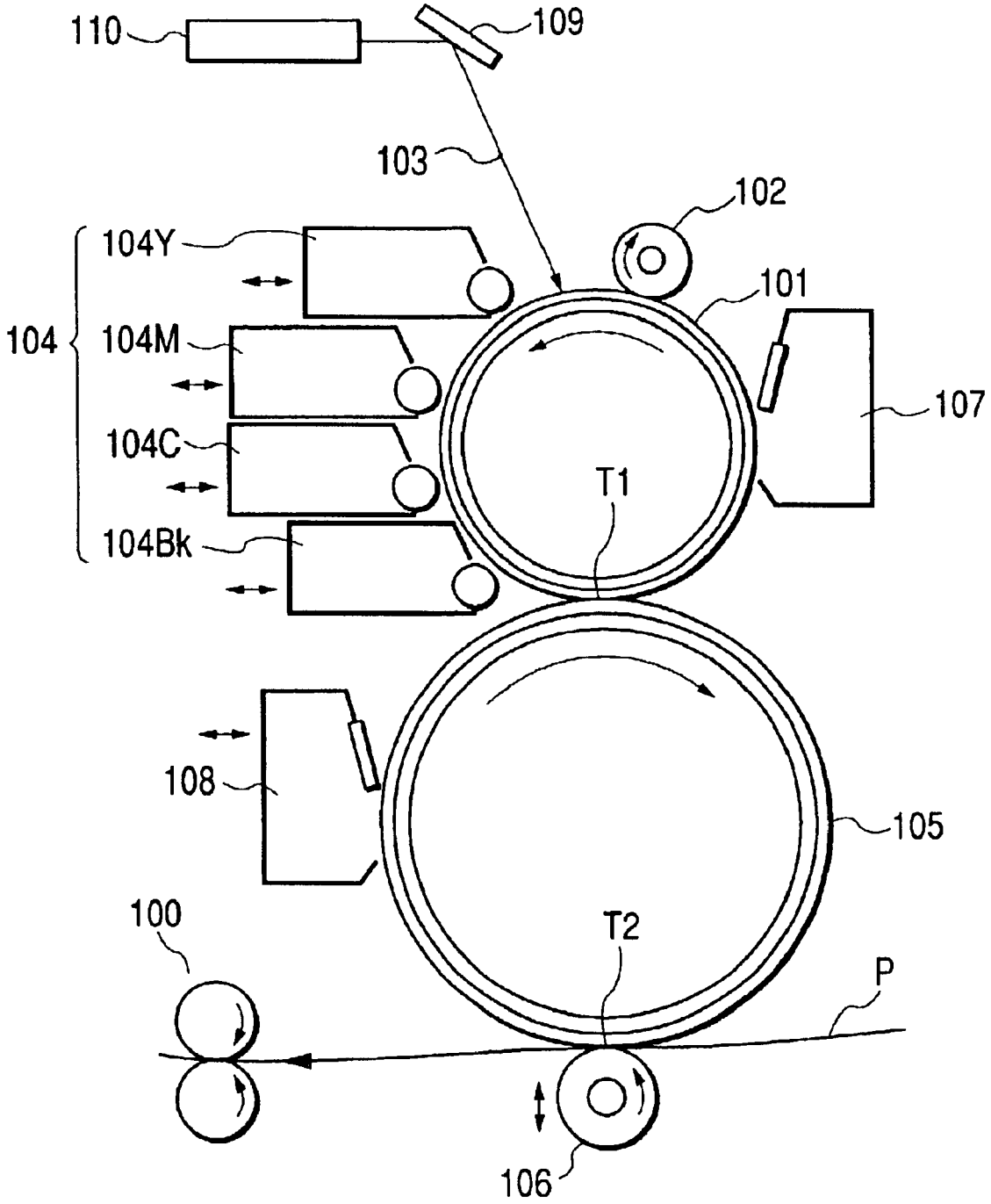
FIG. 1 is a configuration schematic view of an image forming apparatus according to a first embodiment.

FIG. 1 is a configuration schematic view of an example of an image forming apparatus. The image forming apparatus according to this embodiment is a color laser printer.

Reference numeral 101 denotes a photosensitive drum (image bearing member) made of an organic photosensitive member or an amorphous silicon photosensitive member, which is driven to rotate counterclockwise as indicated by an arrow at a predetermined carriage speed (peripheral velocity). The photosensitive drum 101 undergoes a uniform charging process of predetermined polarity and electric potential on a charging apparatus 102 such as a charging roller in the course of its rotation.

Next, a charging-processed surface thereof undergoes a scanning exposure process of target image information with a laser beam 103 outputted from a laser optical box (laser scanner) 110. The laser optical box 110 outputs the laser beam 103 modulated (on/off) according to a time series electric digital pixel signal of the target image information from an unshown image signal generating apparatus such as an image reading apparatus, and an electrostatic latent image according to the target image information scanned and exposed on the photosensitive drum 101 surface is formed. Reference numeral 109 denotes a mirror for deflecting an output laser beam from the laser optical box 110 to an exposure position of the photosensitive drum 101.

In the case of full color image formation, scanning exposure and latent image formation are performed as to a first color separation component image in a target full color image such as a yellow component image, and the latent image thereof is developed as a yellow toner image by the operation of an yellow developing device 104Y of a four-color developing apparatus 104. The yellow toner image is transferred to the surface of an intermediate transfer drum 105 in a primary transfer part T1 which is a contact portion (or a proximity portion) of the photosensitive drum 101 and the intermediate transfer drum 105. The surface of the photosensitive drum 101 after transferring the toner image to the intermediate transfer drum 105 is cleaned by a cleaner 107 by removing a sticking residue such as the toner remaining after transferring.

The above process cycle of charging, scanning exposure, development, primary transfer and cleaning is sequentially performed as to a second color separation component image (such as magenta component image, operation of a magenta developing device 104M), a third color separation component image (such as cyan component image, operation of a cyan developing device 104C), and a fourth color separation component image (such as black component image, operation of a black developing device 104Bk) of the target full color image, and the four-color toner images of yellow, magenta, cyan and black toner images are sequentially transferred in superimposition to the surface of the intermediate transfer drum 105 so as to synthesize and form a color toner image in compliance with the target full color image.

The intermediate transfer drum 105 has a resilient layer of intermediate resistance and a surface layer of high resistance provided on a metallic drum, and is driven to rotate clockwise as indicated by an arrow at the same peripheral velocity as the photosensitive drum 101 while contacting or in proximity to the photosensitive drum 101 so that a bias potential is given to the metallic drum of the intermediate transfer drum 105 to transfer the toner image on the photosensitive drum 101 side to the above described intermediate transfer drum 105 side by means of a potential difference from the photosensitive drum 101.

The color toner image formed on the surface of the above intermediate transfer drum 105 is transferred on the surface of a recording material P fed into a secondary transferring part T2 from an unshown paper feed part in predetermined timing, the above described secondary transferring part T2 being a contact nip portion of the above described intermediate transfer drum 105 and a transferring roller 106. The transferring roller 106 sequentially transfers synthetic color toner images by one operation from the surface side of the intermediate transfer drum 105 to the recording material P side by supplying a charge of a polarity inverse to the toner from the back of the recording material P.

The recording material P having passed through the secondary transferring part T2 is separated from the surface of the intermediate transfer drum 105 to be introduced to an image heating apparatus (fixing apparatus) 100, where an unfixed toner image undergoes a heating and fixing process to become a fixed toner image, and is ejected to an unshown output tray outside the machine. The fixing apparatus 100 will be described in detail in the next section (2).

The intermediate transfer drum 105 after transferring the color toner images to the recording material P is cleaned by a cleaner 108 by having the sticking residue such as the toner remaining after transferring and paper powder removed. The cleaner 108 is ordinarily held in a non-contact state by the intermediate transfer drum 105, and is held in a contact state by the intermediate transfer drum 105 in an implementation process of secondary transferring of the color toner images from the intermediate transfer drum 105 to the recording material P.

In addition, the transferring roller 106 is also ordinarily held in the non-contact state by the intermediate transfer drum 105, and is held in the contact state by the intermediate transfer drum 105 via the recording material P in the implementation process of the secondary transferring of the color toner images from the intermediate transfer drum 105 to the recording material P.

(2) Fixing Apparatus 100

Next, the fixing apparatus 100 provided to the above-mentioned image forming apparatus will be described.

Figure 2:
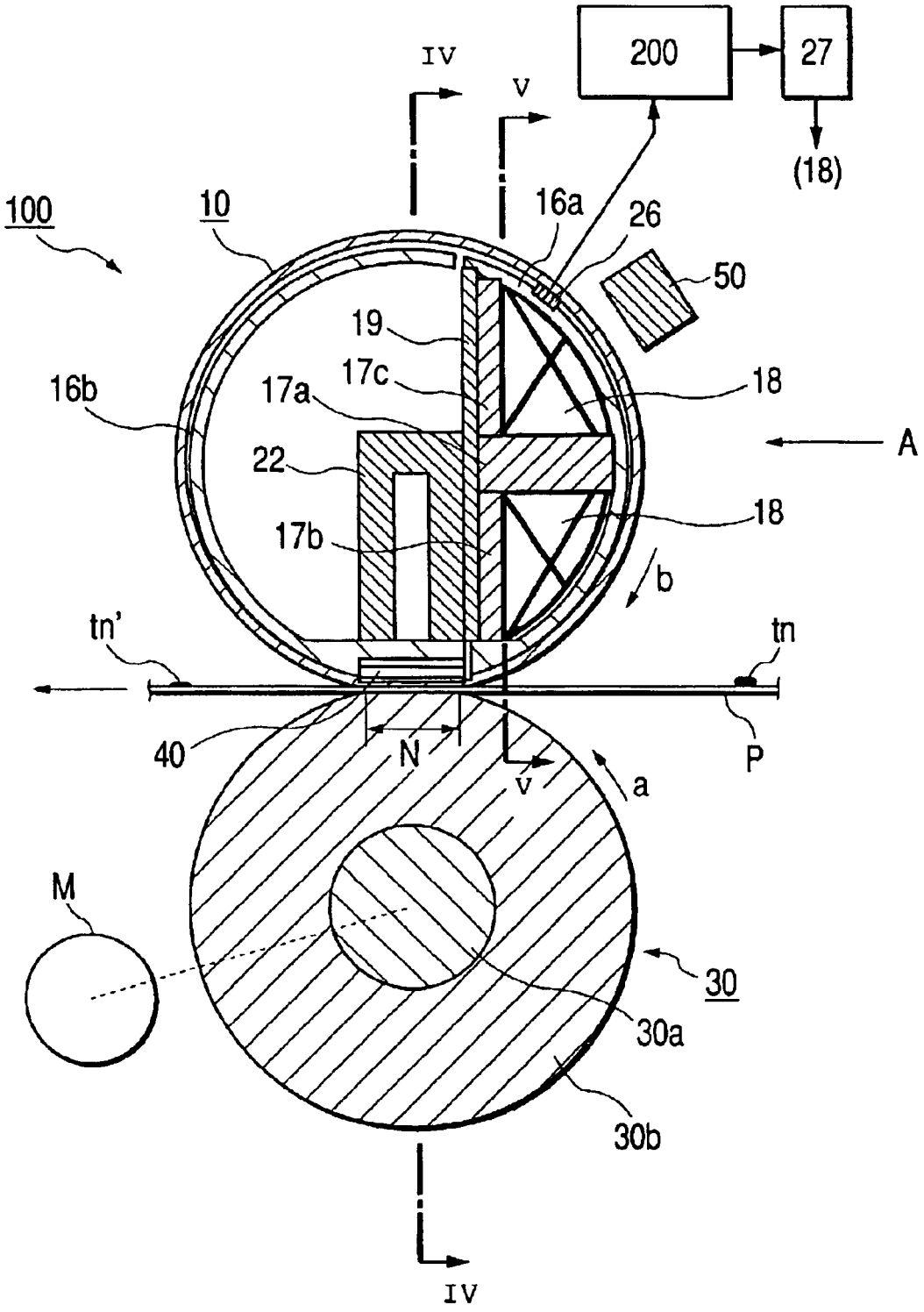
FIG. 2 is a sectional model view of a side of a major portion of a fixing apparatus according to the first embodiment.
Figure 3:
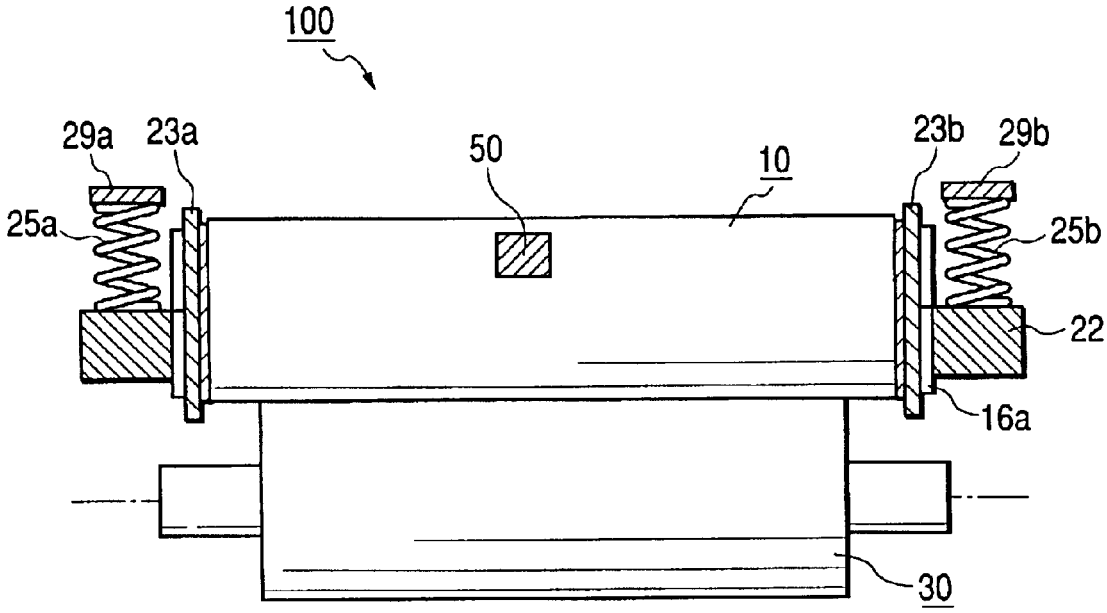
FIG. 3 is a front model view of the major portion of the fixing apparatus according to the first embodiment seen from direction A of FIG. 2.
Figure 4:
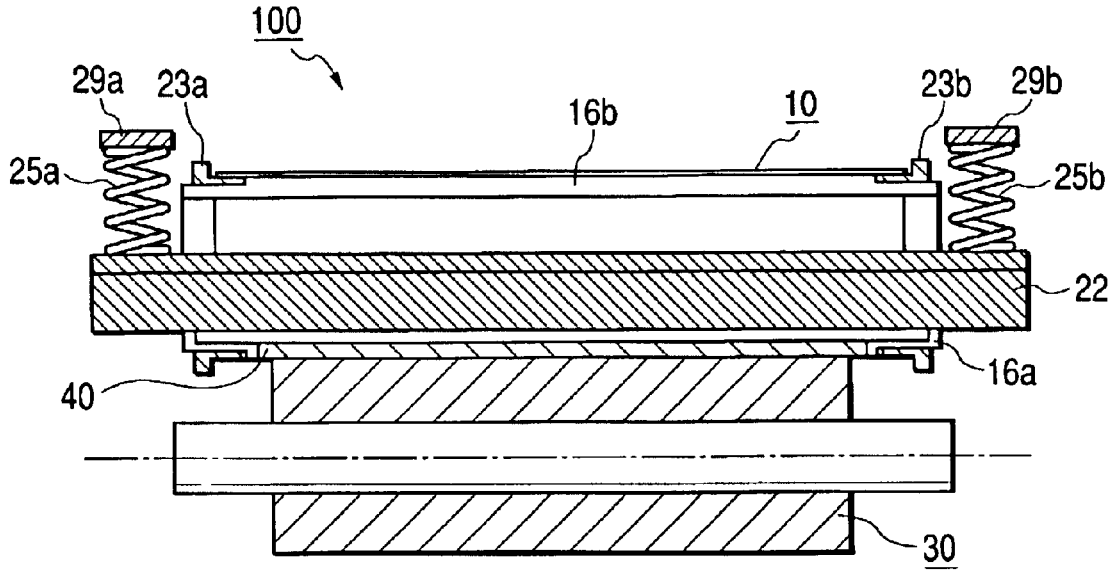
FIG. 4 is a sectional model view of the major portion of the fixing apparatus according to the first embodiment along a line IV—IV of FIG. 2.
Figure 5:
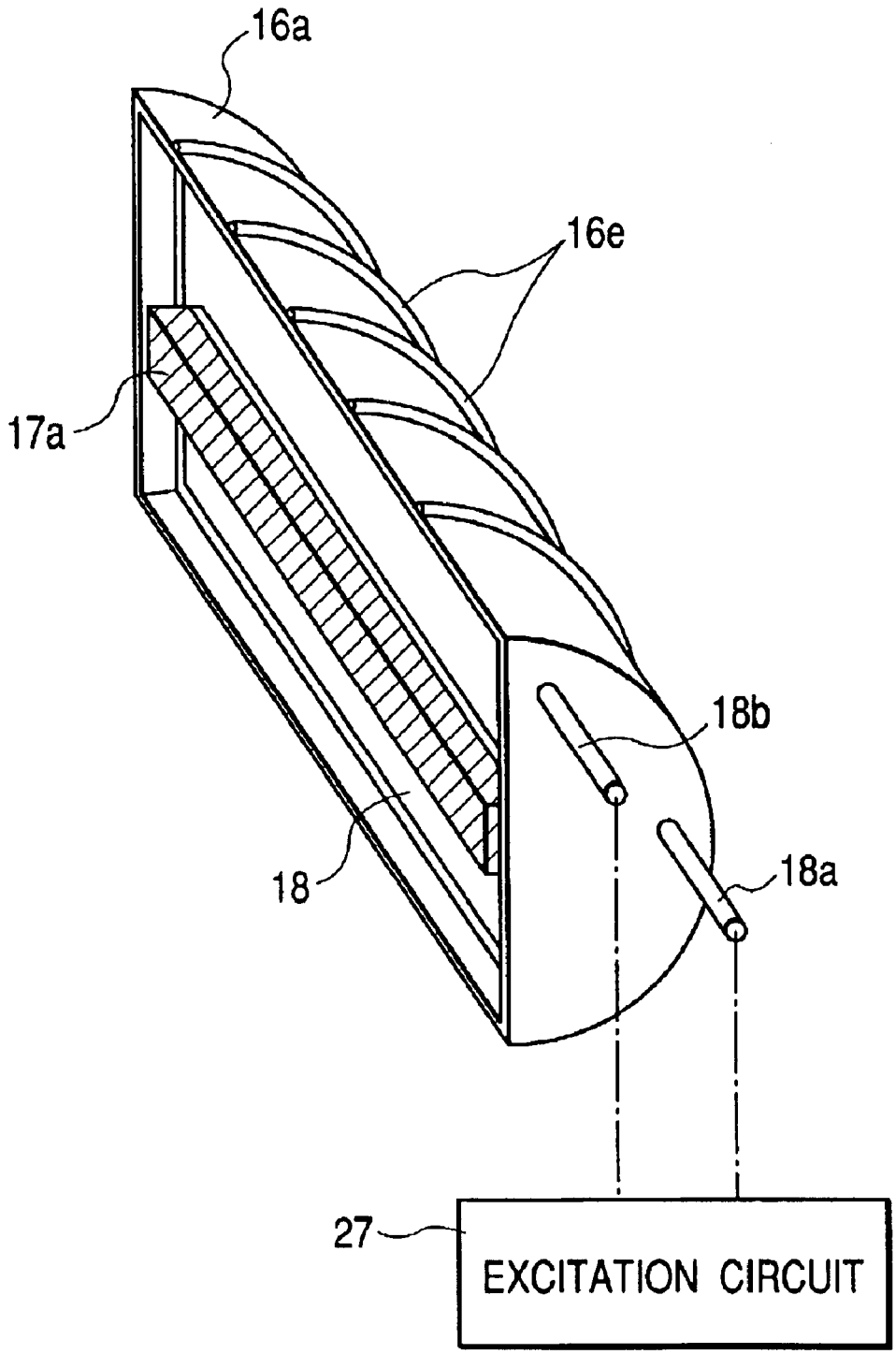
FIG. 5 is a perspective model view of the major portion of the fixing apparatus according to the first embodiment along a line V—V of FIG. 2.

The fixing apparatus 100 according to this embodiment adopts a film heating method using an electromagnetic induction heating method. FIGS. 2 to 5 are the drawings showing a configuration of a major portion of the fixing apparatus 100 according to this embodiment, where FIG. 2 is a sectional model view of the side, FIG. 3 is a front model view seen from direction A of FIG. 2, FIG. 4 is a sectional model view along a line IV—IV of FIG. 2, and FIG. 5 is a perspective model view showing the section along a line V—V of FIG. 2 (fixing film not shown) respectively. Hereafter, the fixing apparatus 100 according to this embodiment will be described by using the drawings.

In FIG. 2, film guides 16*a* and 16*b* have a shape of approximately half-circular gutter in section, forming an approximate cylinder by mutually facing opening sides. A cylindrical fixing film 10 is loosely fitted to the rim surface side of the film guides 16*a* and 16*b*.

Figure 7:
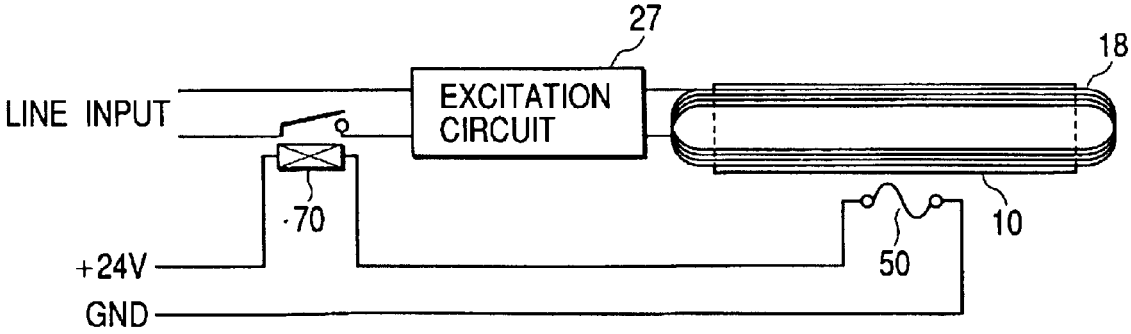
FIG. 7 is a diagram showing a relationship between the magnetic field generating means and an excitation circuit.

Magnetic field generating means is comprised of magnetic cores 17*a*, 17*b* and 17*c*, exciting coils 18 and an excitation circuit 27 (see FIG. 7). The magnetic cores 17*a*, 17*b* and 17*c* are placed like a letter T inside the film guide 16*a*. The exciting coils 18 are held in a space surrounded by the magnetic cores 17*a* and 17*c* and the film guide 16*a* and in a space surrounded by the magnetic cores 17*a* and 17*b* and the film guide 16*a*.

The magnetic cores 17*a*, 17*b* and 17*c* are members of high permeability, desirably the materials used for the core of a transformer such as ferrite and permalloy, and the ferrite of which loss of magnetism over 100 kHz is little is preferably used.

As shown in FIG. 5, the exciting coils 18 have feeding parts 18*a* and 18*b*, and are connected to the excitation circuit 27 by the feeding parts 18*a* and 18*b*. The excitation circuit 27 is capable of generating high frequencies of 200 kHz to 500 kHz with a switching power supply. The exciting coils 18 generate an alternating magnetic flux with an alternating current (high frequency current) supplied from the excitation circuit 27.

The fixing film temperature is controlled by a temperature control system including a temperature sensor 26 so as to keep a predetermined temperature by having current supply to the exciting coils 18 controlled. The temperature sensor 26 is a temperature sensing element such as a thermistor. To be more specific, fixing film sensing temperature information from the temperature sensor 26 is inputted to a control circuit 200, and the control circuit 200 controls the power supplied from the excitation circuit 27 to the exciting coils 18 so as to have input temperature information from the temperature sensor 26 kept at a predetermined fixing temperature.

The film guides 16*a* and 16*b* pressurize a fixing nip part N, support the exciting coils 18 and the magnetic cores 17 as the magnetic field generating means, support the fixing film 10, and stabilize carriage of the fixing film 10 when rotating. For the film guides 16*a* and 16*b*, a material capable of insulation not hindering passage of the magnetic flux and bearing a high load is used. As for such a material, a polyimide resin, a polyamide resin, a polyamide-imide resin, a polyether-ketone resin, a polyether-sulfon resin, a polyphenylene-sulfite resin, a liquid crystal polymer and so on can be named for instance.

As shown in FIG. 2, on the film guide 16*b*, a slide member 40 longitudinal in a paper space vertical direction is placed inside the fixing film 10 on a surface side opposite a pressure roller 30 of the fixing nip part N. To be more specific, the slide member 40 is placed at a position opposite the above described pressure roller 30 via the fixing film 10 in the fixing nip part N. The slide member 40 is a member for supporting the fixing film 10 from its inner circular surface against pressurization of the pressure roller 30 in the fixing nip part N.

As for the slide member 40, a member of good sliding ability is desirable in order to decrease slide resistance. For such a member, fluorine resin, glass, boron nitride, graphite and so on can be named. It is further desirable that the slide member 40 is a member of high thermal conductivity in addition to the sliding ability. Such a slide member 40 has an effect of rendering longitudinal temperature distribution even. For instance, in the case of putting a small-size sheet of paper through, an amount of heat of a non-paper-through part in the fixing film 10 is transmitted to the slide member 40, and the amount is transmitted to a small-size paper-through part by longitudinal thermal transmission of the slide member 40. It is also possible to thereby obtain an effect of reducing power consumption when putting the small-size sheet of paper through. For such a slide member 40, a composite material such as a mirror-polished metal such as aluminum or a metal having fluorine resin particles, boron nitride particles, graphite particles or the like dispersed can be named. In addition, a member of two-layer configuration wherein a member of high thermal transmission is coated with a member of good sliding ability, such as aluminum nitride coated with glass may also be used. In this embodiment, an alumina substrate coated with glass is used.

In the case where the slide member 40 is conductive, it is desirable to place it outside a magnetic field generated from the exciting coils 18 and the magnetic cores 17*a*, 17*b* and 17*c* which are the magnetic field generating means in order not to be affected thereby. To be more specific, the slide member 40 should be placed at a position distant from the magnetic core 17*b* against the exciting coils 18 so as to be placed outside a magnetic path made by the exciting coils 18.

In order to further reduce a slide frictional force of the slide member 40 and the fixing film 10 in the fixing nip part N, it is also possible to place a lubricant such as a heat-resistant grease between the slide member 40 and the fixing film 10. Application of the lubricant allows further reduction in slide resistance and longer life of the apparatus.

An internal plane part of the film guide 16*b* has in contact a rigid stay for pressurization 22 having a horizontally long horseshoe sectional shape. In addition, an insulating member 19 is provided between the rigid stay for pressurization 22 and each of the magnetic cores 17 for the purpose of insulating them.

Moreover, flange members 23*a* and 23*b* (see FIG. 3) are fitted to the outside of both the right and left ends of assembly of the film guides 16*a* and 16*b*, and are rotatably mounted while fixing the above described right and left positions. The flange members 23 receive an end portion of the fixing film 10 when rotating and regulate a longitudinal approach motion of the film guides 16.

The pressure roller 30 as the rotating pressure member is comprised of a core bar 30*a* and a heat-resistant resilient material layer 30*b* such as silicone rubber, fluorine rubber or fluorine resin, concentrically and integrally formed and coated around the above described core bar in a state of a roller. The pressure roller 30 is mounted by having both end portions of the core bar 30*a* held by bearings rotatably between chassis-side sheet metals (not shown) of the fixing apparatus.

In FIG. 3, pressure springs 25*a* and 25*b* are mounted in a pressed state between both the end portions of the rigid stay for pressurization 22 and spring bracket members 29*a* and 29*b* on the apparatus chassis (not shown) side respectively, so that a depressing force is applied to the rigid stay for pressurization 22. Thus, the downside of the slide member 40 provided to the film guide 16*b* and the topside of the pressure roller 30 come into contact due to pressure, sandwiching the fixing film 10 so that the fixing nip part N of a predetermined width is formed.

The pressure roller 30 is driven by a driving means M to rotate counterclockwise as indicated by an arrow a in the drawing. The rotation drive of the pressure roller 30 generates frictional force between the pressure roller 30 and an outer surface of the fixing film 10 so that a torque acts upon the fixing film 10. And the fixing film 10 rotates around the rims of the film guides 16*a* and 16*b* clockwise as indicated by the arrow b in the drawing at the peripheral velocity approximately equal to that of the pressure roller 30 while sliding with its internal circular face kept in intimate contact with the downside of the slide member 40 in the fixing nip part N. To be more specific, the fixing film 10 is rotated in synchronization with the pressure roller 30 by surface frictional force exerted with the pressure roller.

As shown in FIG. 5, on a rim surface of the film guide 16*a*, a plurality of convex rib parts 16*e* are formed longitudinally with predetermined intervals. A contact slide resistance between the rim surface of the film guide 16*a* and an internal surface of the fixing film 10 is thereby reduced so as to decrease a rotation load of the fixing film 10. Such convex rib parts can be formed and provided likewise to the film guide 16*b*.

Figure 6:
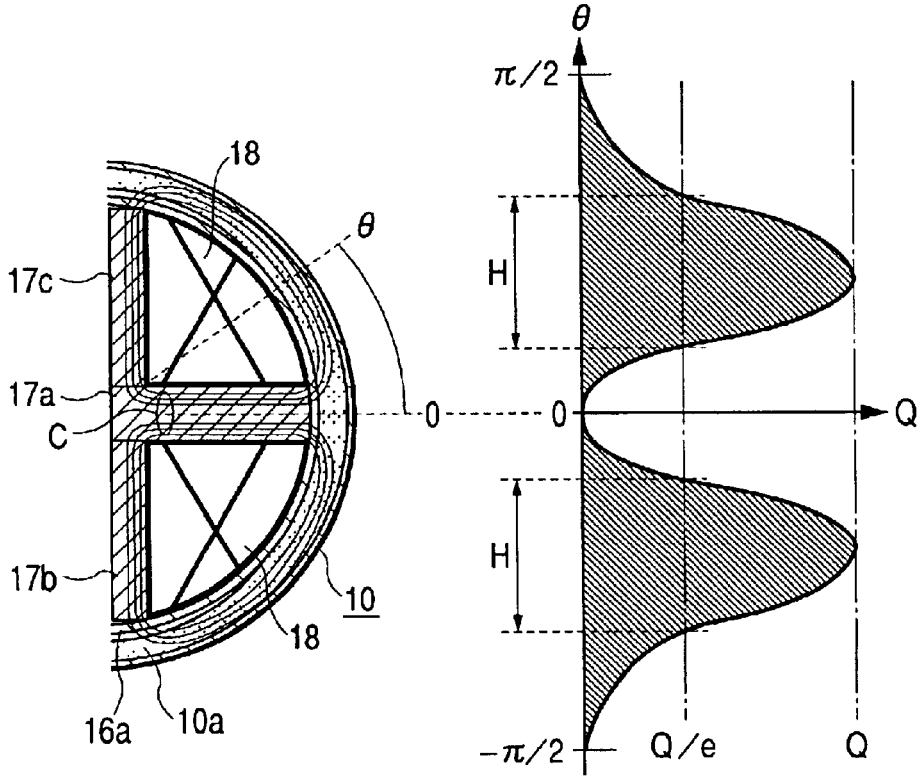
FIG. 6 is a diagram showing a relationship between magnetic field generating means and heat capacity Q.

FIG. 6 schematically represents how the alternating magnetic flux is generated by the magnetic field generating means.

A magnetic flux C represents a part of the generated alternating magnetic flux. The magnetic flux C led by the magnetic cores 17*a*, 17*b* and 17*c* generates the eddy current in a heat generating layer 10*a* of the fixing film 10 between the magnetic cores 17*a* and 17*b* and between the magnetic cores 17*a* and 17*c*. The eddy current has Joule heat (eddy current loss) generated in the heat generating layer 10*a* due to specific resistance of the heat generating layer 10*a*.

An amount of heat Q is determined by a density of the magnetic flux C passing through the heat generating layer 10*a*, and shows distribution as in the graph in FIG. 6. In the graph shown in FIG. 6, the vertical axis indicates the position of a circumferential direction in the fixing film 10 represented by an angle θ with the center of the magnetic core 17*a* as 0, and the horizontal axis indicates the amount of generated heat Q in the heat generating layer 10*a* of the fixing film 10. Here, it is defined that a heat generating area H is the area of which maximum amount of the generated heat is Q, and amount of generated heat is Q/e or larger (e is a base of natural logarithm). This is the area capable of obtaining the amount of generated heat necessary for a fixing process.

As described above, the exciting coils 18 are fed by the excitation circuit 27 so that the fixing film 10 performs electromagnetic induction heating and rises to the predetermined temperature. And in a state of being controlled at the predetermined temperature, the recording material P having an unfixed toner tn image carried from the image forming means part formed thereon is introduced between the fixing film 10 and the pressure roller 30 so as to have an image surface opposite the fixing film surface. And in the process of having the recording material P supported and carried together with the fixing film 10 in the fixing nip part N, the unfixed toner tn on the recording material P is heated and fixed. After passing through the fixing nip part N, the unfixed toner tn is cooled to become a fixed toner tn'.

As the toner containing a low softening substance is used as the toner tn in this embodiment, an oil application mechanism for preventing an offset is not provided to the fixing apparatus 100. In the case of using the toner containing no low softening substance, the oil application mechanism may be provided. In addition, oil application and cooling separation may be performed even in the case of using the toner containing the low softening substance.

A thermo switch 50 which is the temperature sensing element for interrupting feeding to the exciting coils 18 on a thermorunaway of the fixing apparatus is placed with no contact at a position opposite to the heat generating area H (see FIG. 6) on an outer surface of the fixing film 10. Distance between the thermo switch 50 and the fixing film 10 is approximately 2 mm. Thus, the fixing film 10 will not have a flaw due to contact with the thermo switch 50, and so it is possible to prevent deterioration of the fixed image due to enduring use thereof.

FIG. 7 is a circuit diagram of a thermorunaway preventing circuit used in this embodiment. The thermo switch 50 is built into this thermorunaway preventing circuit. The thermo switch 50 is serially connected to a 24V DC power supply and a relay switch 70. If the thermo switch 50 is turned off, the feeding to the relay switch 70 is interrupted, and the relay switch 70 operates to interrupt the feeding to the excitation circuit 27 so as to interrupt the feeding to the exciting coils 18.

According to this embodiment, on the thermorunaway of the fixing apparatus 100 due to a failure of the temperature control, the fixing apparatus 100 stops in a state of having the recording material P caught in the fixing nip part N, and even if the feeding to the exciting coils 18 is continued and the fixing film 10 keeps on generating heat, no heat is generated in the fixing nip part N with the recording material P caught, and so the recording material P will not be directly heated, which is different from the configuration wherein the heat is generated in the fixing nip part N. In addition, the thermo switch 50 is placed in the heat generating area H having a large amount of generated heat, so that the relay switch 70 operates to interrupt the feeding to the exciting coils 18 at a point in time when the thermo switch 50 senses an abnormal rise in temperature and becomes open. According to this embodiment, no paper gets ignited since ignition temperature of the paper is around 400 degrees, and thus heat generation of the fixing film 10 can be stopped. A thermal fuse may also be used in addition to the thermo switch.

Hereafter, each of the members used for the above-mentioned fixing apparatus (heating apparatus) will be described.

2-A) Exciting Coils 18

The exciting coils 18 constituting the magnetic field generating means use a bundle of a plurality of thin lines made of copper insulated and coated one by one as a conductor (electric wire) constituting a coil (line ring), which is wound more than once so as to form the exciting coils.

As for the coating member for performing insulating coating, it is desirable to use a heat-resistant coating in consideration of the heat transmission by the heat generation of the fixing film 10. For instance, it is preferable to use the coating of amide-imide, polyimide or the like. It is also feasible to pressurize the exciting coils 18 from the outside so as to improve density.

As in FIG. 2, the shape of the exciting coils 18 is formed along a curved surface of the fixing film 10. In addition, the distance between the heat generating layer of the fixing film 10 and the exciting coils 18 is set to be approximately 2 mm.

As for the material of the insulating member 19, the one having good insulation performance and high heat resistance is desirable. For instance, it is preferable to select phenol resin, fluorine resin, polyimide resin, polyamide resin, polyamide-imide resin, polyether-ketone resin, polyether-sulfon resin, polyphenylene-sulfite resin, PFA resin, PTFE resin, FEP resin, LCP resin and so on.

The distances between the magnetic cores 17*a*, 17*b*, 17*c*/exciting coils 18 and the heat generating layer of the fixing film 10 should be as close as possible to render absorption efficiency of the magnetic flux higher. It is desirable if the distance is 5 mm or less since the fixing film can absorb the magnetic flux with high efficiency. It is not desirable for the distance to be larger than the above range since the absorption efficiency of the magnetic flux is remarkably reduced thereby. In addition, as far as the distance between the heat generating layer of the fixing film 10 and the exciting coils 18 is 5 mm or less, it is not necessary for the distance to be fixed.

Moreover, as for 18*a* and 18*b* drawn out of the exciting coils 18 in FIG. 5, the insulating coating is performed on the outside of the bundled lines.

2-B) Fixing Film 10 (Rotating Heating Member)

Figure 8:
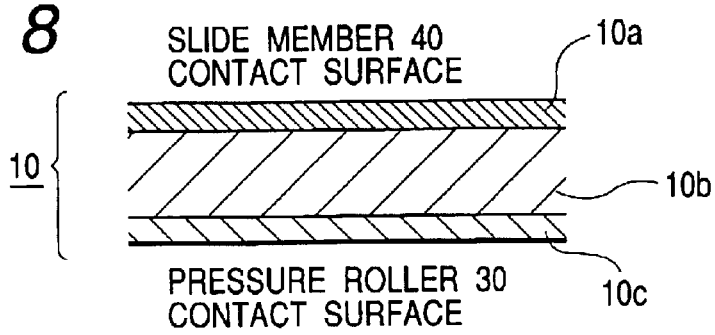
FIG. 8 is a layer constitution model view of a fixing film.

FIG. 8 is a layer constitution model view of the fixing film 10 as the heating member in this embodiment. The fixing film 10 according to this embodiment has a complex configuration of the heat generating layer 10*a* as a base layer comprised of an electromagnetic induction heating metallic film or the like, a resilient layer 10*b* laminated on the outer surface thereof, and a mold release layer 10*c* laminated on the outer surface thereof. It is also possible to provide primer layers (not shown) among the layers for the purpose of adhesion between the heat generating layer 10*a* and resilient layer 10*b* and adhesion between the resilient layer 10*b* and mold release layer 10*c*. Moreover, in the approximately cylinder-shaped fixing film 10 in FIG. 8, the heat generating layer 10*a* is inside for contacting the slide member 40, and the mold release layer 10*c* is outside for contacting the pressure roller or the recording material (heating material).

As previously mentioned, the alternating magnetic flux acts upon the heat generating layer 10*a* to generate the eddy current therein so that the heat generating layer 10*a* generates heat. The heat is transmitted to the resilient layer 10*b* and mold release layer 10*c* to heat the entire fixing film so that the recording material P put through the fixing nip part N is heated and the toner image is heated and fixed.

a. Heat Generating Layer 10*a*

While a magnetic or non-magnetic metal may be used for the heat generating layer 10*a*, the magnetic metal is preferably used. As for such a magnetic metal, a ferromagnetic metal such as nickel, iron, ferromagnetic stainless, nickel-cobalt alloy or permalloy is preferably used. In addition, it is also desirable to use a member wherein manganese is added to the nickel in order to prevent metal fatigue caused by repeated curvature stress received on the rotation of the fixing film 10.

As for thickness of the heat generating layer 10*a*, it should preferably be thicker than a skin depth σ(m) represented by the following equation and 200 μm or less. If the thickness of the heat generating layer 10*a* is in this range, the heat generating layer 10*a* can efficiently absorb an electromagnetic wave so that the heat can be efficiently generated.

$$\sigma=(\rho/\pi f\mu)^{1/2} \quad (1)$$

Here, f is a frequency (Hz) of the excitation circuit, μ is permeability of the heat generating layer 10*a*, and ρ is a specific resistance (Ωm) of the heat generating layer 10*a*.

Figure 10:
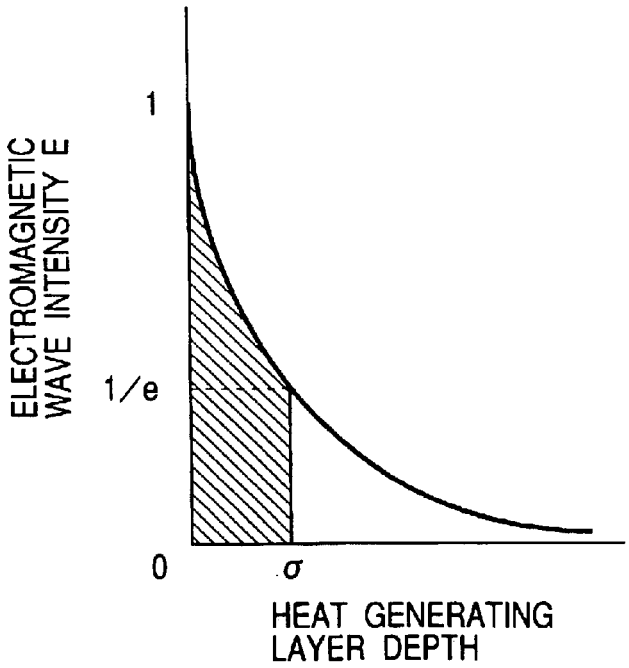
FIG. 10 is a graph showing the relationship between heat generating layer depth and electromagnetic wave intensity.

The skin depth σ indicates the depth of the absorption of the electromagnetic wave used for electromagnetic induction, and the intensity of the electromagnetic wave at a location deeper than that is 1/e or less. To put it inversely, most of the energy is absorbed to this depth (see the relationship between the heat generating layer depth and the electromagnetic wave intensity shown in FIG. 10).

The thickness of the heat generating layer 10*a* should more preferably be 1 to 100 μm. In the case where the thickness of the heat generating layer 10*a* is thinner than the above range, it will be less efficient since most of the electromagnetic energy cannot be absorbed. In addition, in the case where the heat generating layer 10*a* is thicker than the above range, rigidity of the heat generating layer 10*a* becomes too high, and the curvature becomes deteriorated so that it will not be realistic to use it as a rotating member.

b. Resilient Layer 10*b*

For the resilient layer 10*b*, a material of high heat resistance and high thermal conductivity such as silicone rubber, fluorine rubber or fluoro-silicone rubber is preferably used.

The thickness of the resilient layer 10*b* should preferably be 10 to 500 μm in order to assure quality of the fixed image. In the case of printing the color image, and in particular a photographic image, a solid image is formed over large area on the recording material P. In this case, unevenness in heating arises if the heated surface (mold release layer 10*c*) cannot follow projections and depressions on the recording material P or those on the unfixed toner tn, and unevenness in gloss arises between the portions of large and small amounts of transmitted heat. To be more specific, glossiness is high in the portion of large amount of transmitted heat, and it is low in the portion of small amount thereof. In the case where the thickness of the resilient layer 10*b* is smaller than the above range, the above mold release layer 10*c* cannot follow the projections and depressions of the recording material P or the unfixed toner tn so that image gloss unevenness arises. In addition, in the case where the resilient layer 10*b* is excessively larger than the above range, the heat resistance of the resilient layer is too high such that it is difficult to implement a quick start. The thickness of the resilient layer 10*b* should more preferably be 50 to 500 μm.

If hardness of the resilient layer 10*b* is too high, it cannot follow the projections and depressions of the recording material P or the unfixed toner tn so that image gloss unevenness arises. Thus, the hardness of the resilient layer 10*b* should be 60 degrees (JIS-A) or less, and more preferably 45 degrees (JIS-A) or less.

Thermal conductivity λ of the resilient layer 10*b* should preferably be $2.5\times10^{-1}$ to $8.4\times10^{-1}$ W/m·° C. In the case where the thermal conductivity λ is smaller than the above range, the heat resistance is too large such that the rise in temperature in the surface layer (mold release layer 10*c*) of the fixing apparatus 10 becomes slow. In the case where the thermal conductivity λ is larger than the above range, the hardness of the resilient layer 10*b* becomes too high or a compression set is apt to arise. It should more preferably be $3.3\times10^{-1}$ to $6.3\times10^{-1}$ W/m·° C.

c. Mold Release Layer 10*c*

For the mold release layer 10*c*, a material of good mold releasability and high heat resistance such as fluorine resin, silicone resin, fluoro-silicone rubber, fluorine rubber, silicone rubber, PFA, PTFE or FEP should preferably be used.

The thickness of the mold release layer 10*c* should preferably be 1 to 100 μm. In the case where the thickness of the mold release layer 10*c* is thinner than the above range, unevenness in painting of a coating film arises so that problems such as occurrence of a portion of low mold releasability and lack in endurability arise. In addition, in the case where the mold release layer is thicker than the above range, the thermal conductivity deteriorates. In particular, in the case of using a resin material for the mold release layer 10*c*, the hardness of the mold release layer 10*c* becomes so high that the resilient layer 10*b* is no longer effective.

Figure 9:
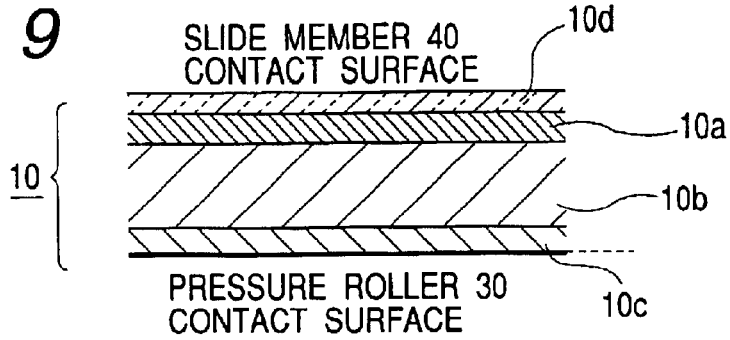
FIG. 9 is a layer constitution model view of the fixing film (with an adiabatic layer)

As shown in FIG. 9, it is also possible, in the fixing film 10 configuration, to provide an adiabatic layer 10*d* on the surface side of the heat generating layer 10*a* contacting the slide member 40. For the adiabatic layer 10*d*, a heat-resistant resin such as fluorine resin, polyimide resin, polyamide resin, polyamide-imide resin, PEEK resin, PES resin, PPS resin, PFA resin, PTFE resin or FEP resin should preferably be used. In addition, the thickness of the adiabatic layer 10*d* should preferably be 10 to 1000 μm. In the case where the thickness of the adiabatic layer 10*d* is thinner than 10 μm, no adiabatic effect is obtained and endurability is also insufficient. On the other hand, if it exceeds 1000 μm, the distance from the magnetic cores 17*a*, 17*b*, 17*c*/exciting coils 18 to the heat generating layer 10*a* becomes so large that the magnetic flux is no longer sufficiently absorbed by the heat generating layer 10*a*. As the adiabatic layer 10*d* can insulate the heat generated in the heat generating layer 10*a* so that the heat will not go inside the fixing film, efficiency of heat supply to the recording material P is better compared to the case of having no adiabatic layer 10*d*. Thus, it is possible to control power consumption.

In addition, it is possible to alleviate the slide resistance between the slide member 40 and the fixing film 10 by constituting the adiabatic layer 10*d* with a material of good slidability.

(3) Starting Step

Hereafter, the temperature control in the temperature control starting step of the fixing apparatus 100 on the start of printing will be described. The control is implemented by a control circuit part 200 (FIG. 2).

The control circuit 200 administers overall sequence of the image forming apparatus. And the control circuit 200 predicts the time required by the fixing apparatus 100 for the rise in temperature to the target temperature.

Figure 11:
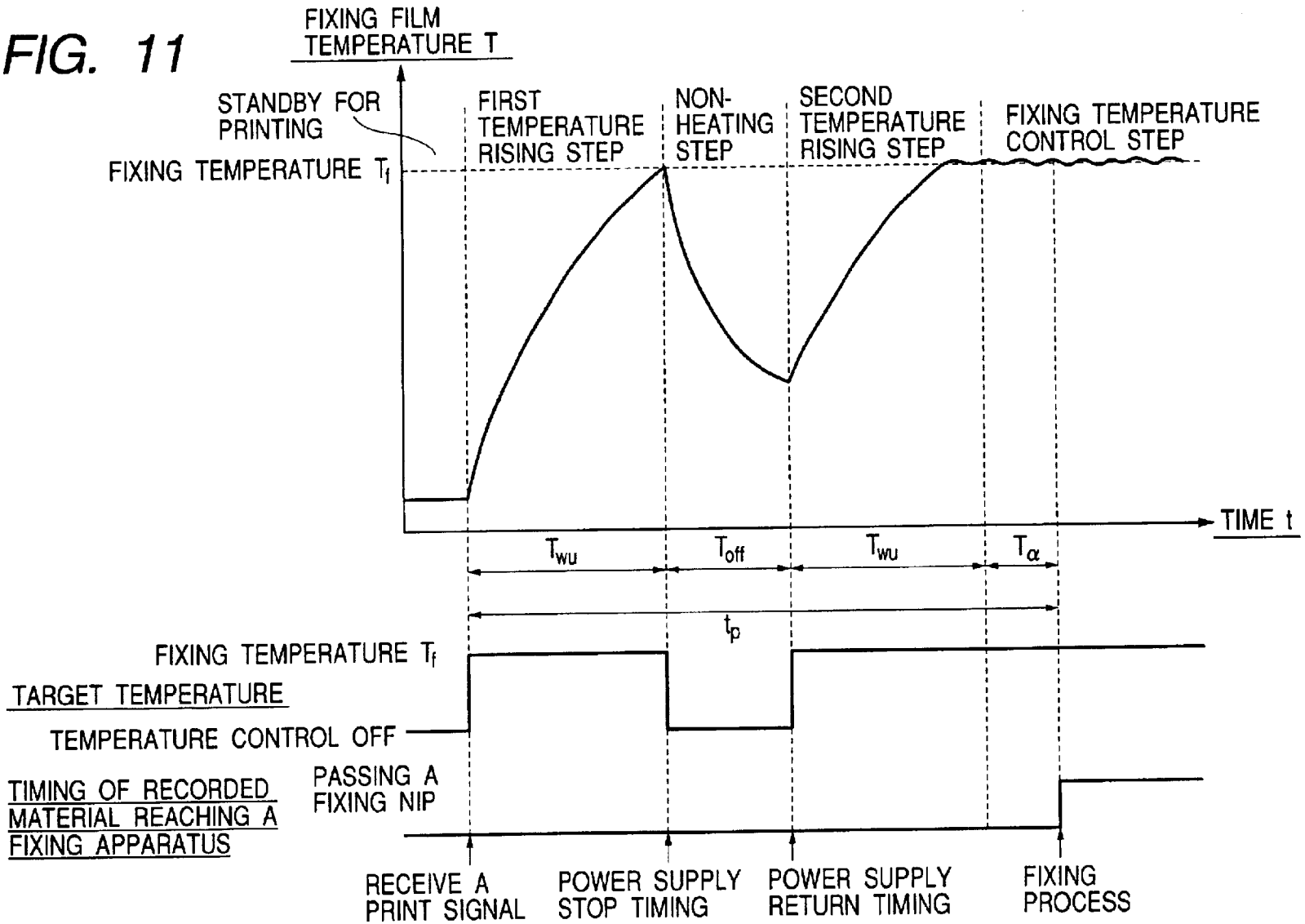
FIG. 11 is a schematic view showing temperature control in a starting step of the fixing apparatus according to the first embodiment.
Figure 12:
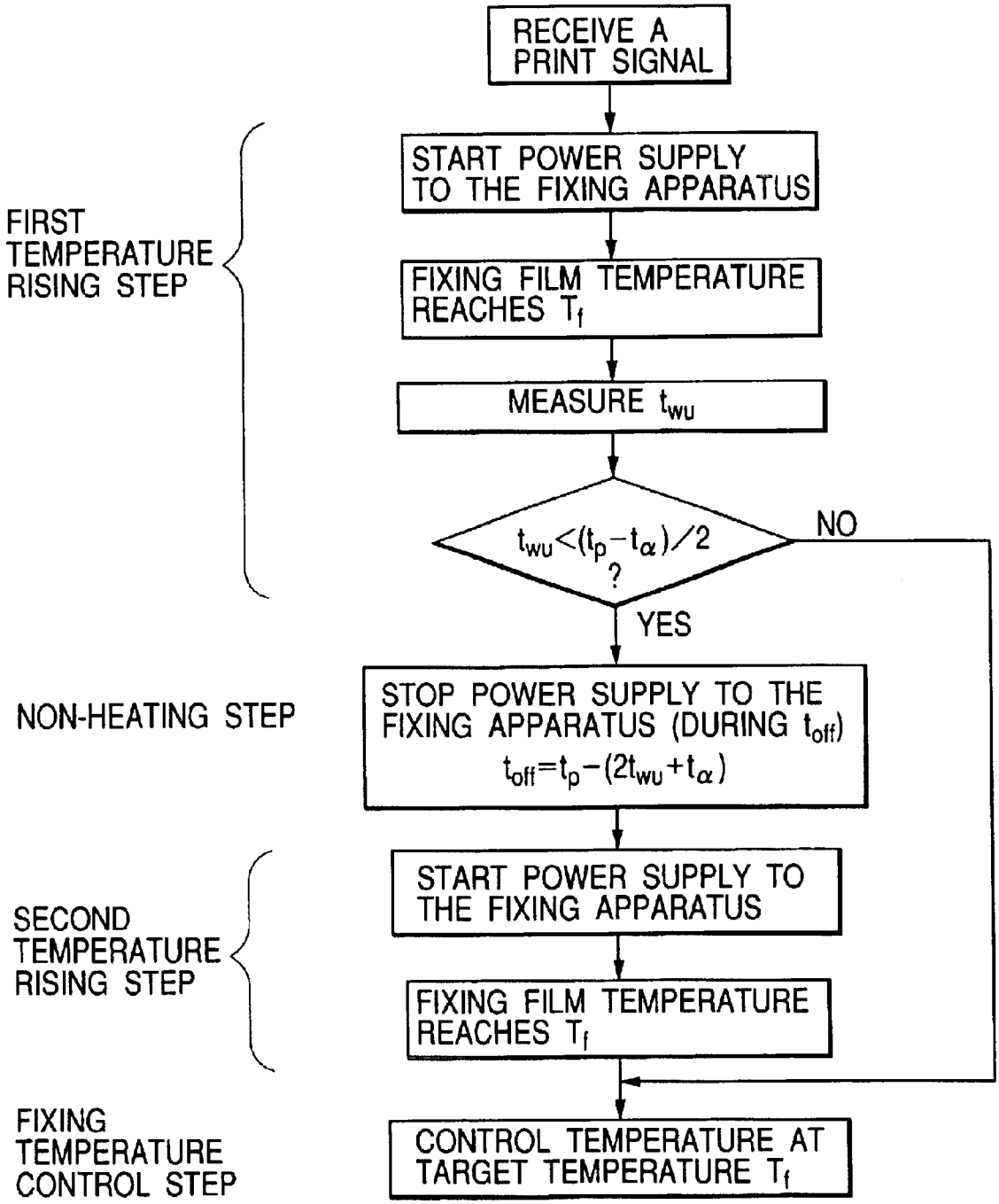
FIG. 12 is a temperature control flowchart according to the first embodiment.

FIG. 11 is a schematic view showing the fixing film temperature, setting of the target temperature of the temperature control, and timing of the recording material reaching the fixing apparatus in the starting step of the fixing apparatus according to this embodiment. FIG. 12 is a flowchart of control sequence performed by the control circuit 200.

Although the fixing apparatus according to this embodiment keeps the temperature control off to perform no preheating during standby for printings preheating may also be performed.

After receiving the print signal, the image forming apparatus starts the image forming operation. In a first temperature rising step, it starts the image forming operation and also starts power supply to the fixing apparatus at the same time. As for the timing of starting the first temperature rising step, it may be implemented after the receipt of the print signal, and is not limited to implementing it at the same time as the start of the image forming operation. The fixing apparatus starts to increase the temperature aiming at the target temperature, and in this embodiment, the target temperature of the first temperature rising step is the fixing temperature $T_f$ to be used when fixing the toner on the recording material. And it measures time $t_{wu}$ required to increase the temperature to the fixing temperature $T_f$ from the start of the power supply to the fixing apparatus. Once it reaches the target temperature, the first temperature rising step is finished.

Next, it determines whether or not the non-heating step can be implemented and time for implementation thereof. This embodiment is characterized by predicting temperature rising time of the fixing apparatus in the second temperature rising step rather than that in the first temperature rising step.

According to this embodiment, the time $t_{wu}$ required to increase the temperature to the fixing temperature $T_f$ in the first temperature rising step is measured by setting the target temperature in the first temperature rising step at the fixing temperature $T_f$ as in the second temperature rising step. The temperature rising time $t_{wu}$ reflects elements related to the rise in the temperature of the fixing apparatus such as a surrounding ambient temperature, input voltage and a state of warming up of the fixing apparatus. The time required for the second temperature rising step is the temperature rising time $t_{wu}$ in the first temperature rising step or less considering that the fixing apparatus is warmed up in the first temperature rising step. Thus, it is possible to assuredly increase the temperature to the fixing temperature $T_f$ by securing the time $t_{wu}$ as the time required for the second temperature rising step.

Whether or not the non-heating step to be performed after finishing the first temperature rising step can be implemented and the time for implementation $t_{off}$ are determined by the equation described hereafter.

If the time from the start of the first temperature rising step until fixing of the recording material is $t_p$, the time required for the first temperature rising is $t_{wu}$, the time for performing the non-heating step is $t_{off}$, the time allotted for the second temperature rising is $t_{wu}$, and spare time from starting the fixing temperature control step until entry of the recording material into the fixing nip is $t\alpha$, the following relationship holds.

$$t_p = t_{wu} + t_{off} + t_{wu} + t\alpha \quad (1)$$

To implement the non-heating step, the following relationship must be fulfilled from equation (1).

$$t_{off} = t_p - (2t_{wu} + t\alpha) > 0 \quad (2)$$

To be more specific, it is possible to implement the non-heating step if the temperature rising time $t_{wu}$ satisfies the following.

$$t_{wu} < (t_p - t\alpha)/2 \quad (3)$$

In the case where the temperature rising time $t_{wu}$ cannot satisfy equation (3), implementation of the non-heating step does not allow the second temperature rising step to be in time, and so it moves on to the fixing temperature control step without implementing the non-heating step.

On the other hand, in the case of implementing the non-heating step, the time for the non-heating step $t_{off}$ is the time calculated by the equation (2).

In the case where the starting step is repeated many times as with intermittent printing, the fixing apparatus is warmed up and the temperature rising time $t_{wu}$ becomes shorter, it is possible to render the time for the non-heating step $t_{off}$ longer. In addition, in the case where processing speed is slow and the time for carrying the recording material $t_p$ is long as when fixing an OHP film, it is also possible to render the time for the non-heating step $t_{off}$ longer.

After finishing the first temperature rising step, the non-heating step is implemented. In this step, the power supply to the fixing apparatus is stopped, and the fixing apparatus is put in a non-heating state. The time for the non-heating step $t_{off}$ is the time from the timing of finishing the first temperature rising step until the timing of starting the second temperature rising step mentioned later. The longer the time for the non-heating step $t_{off}$ is, the more the temperature rising of the pressure roller can be controled. In addition, it is also possible to control the temperature rising inside the image forming apparatus and to reduce the power consumption.

After finishing the non-heating step, the second temperature rising step is implemented. The target temperature in the second temperature rising step is the fixing temperature $T_f$. The second temperature rising step has the previously measured temperature rising time $t_{mv}$ allotted thereto.

After finishing the second temperature rising step, the fixing temperature control step is implemented. In the fixing temperature control step, the spare time $t\alpha$ is provided as the time from starting the fixing temperature control step until entry of the recording material into the fixing nip. It is possible, during this time, to control overshooting of the temperature and control oscillation immediately after the rise in the temperature and also to fix the recording material after stabilizing the temperature of the fixing apparatus. Then, it keeps the fixing film at the fixing temperature $T_f$ and fixes the unfixed toner image on the recording material after carrying the recording material to the fixing apparatus.

As it is possible, by the above-mentioned temperature control of the fixing apparatus, to control excessive temperature rising of the pressure roller in the starting step, it allows slipping of the recording material to be prevented, and it is also feasible to stabilize the carriage of the recording material and to render the fixed image of higher quality. In addition, it is also possible to have energy conservation effects such as reduction in power consumption and a decreased temperature rise in the machine.

(Second Embodiment)

Hereafter, the temperature control in the starting step of the fixing apparatus on the start of the printing according to a second embodiment will be described. The configurations of the image forming apparatus and the fixing apparatus are the same as those in the first embodiment.

Figure 14:
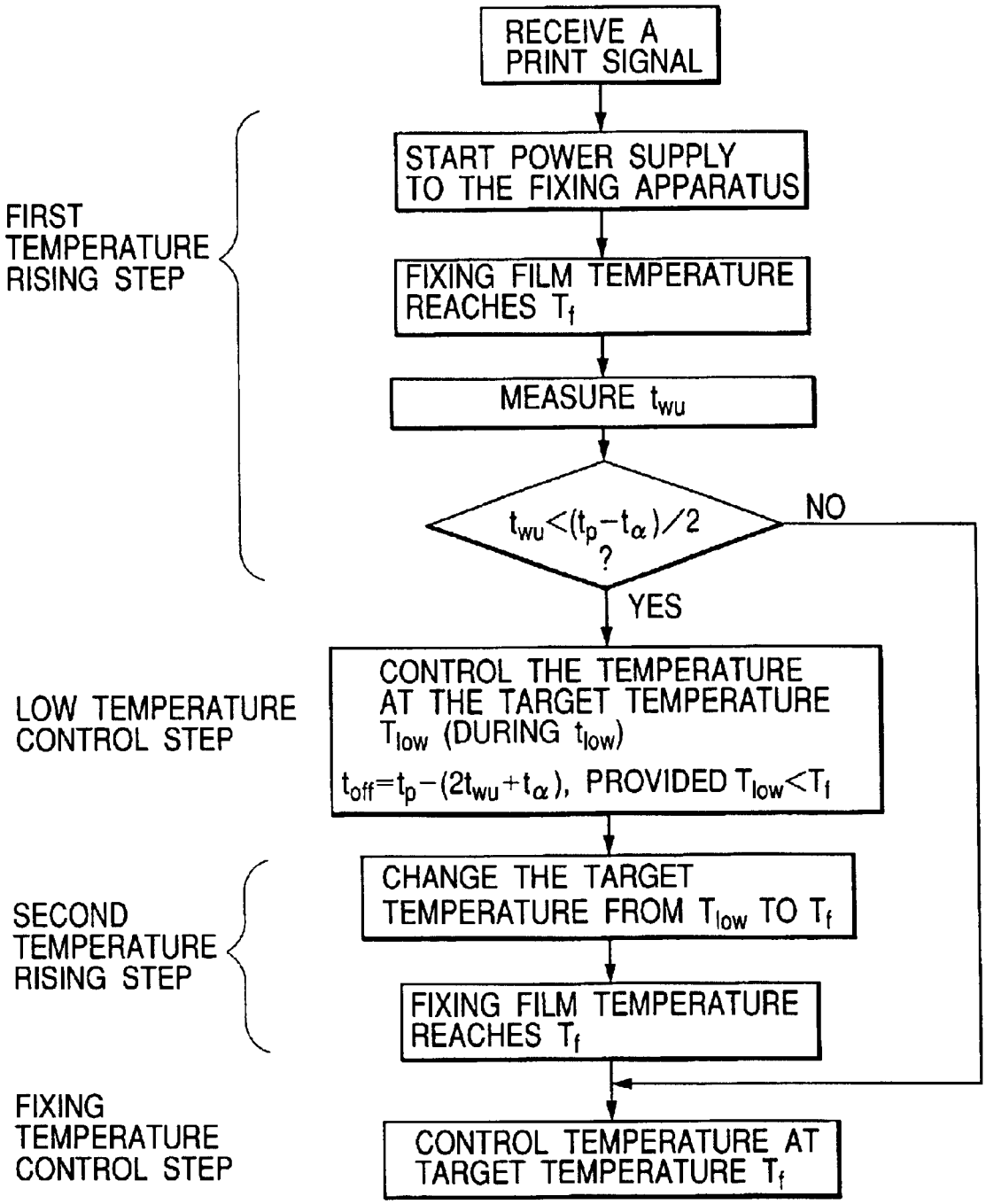
FIG. 14 is a temperature control flowchart according to the second embodiment.

FIG. 13 is a schematic view showing the fixing film temperature, setting of the target temperature of the temperature control and the timing of the recording material reaching the fixing apparatus in the starting step of the fixing apparatus according to this embodiment. FIG. 14 is a flowchart of a control sequence performed by the control circuit 200.

As the temperature control in the first temperature rising step, the second temperature rising step and the fixing temperature control step is the same as those in the first embodiment during standby for printing, description thereof will be omitted.

This embodiment is characterized by providing the low temperature control step for controlling the target temperature at a temperature $T_{low}$ which is lower than the fixing temperature $T_f$ instead of providing the non-heating step for stopping the power supply to the fixing apparatus as in the first embodiment. It is the same as the non-heating step in the first embodiment as to whether or not the low temperature control step can be implemented and the method of calculating implementation time $t_{low}$. Thus, a minimum limit temperature of the fixing apparatus is assured even if the fixing apparatus is excessively cooled in the low temperature control step. Therefore, it is possible to securely complete the second temperature rising step within the predetermined time irrespective of fluctuation of the ambient temperature surrounding the image forming apparatus. To control the rise in the temperature of the pressure roller, it is preferable that the target temperature $T_{low}$ in the low temperature control step is low. In addition, although no preheating is performed during standby for printing in this embodiment, the target temperature $T_{low}$ in the low temperature control step may be the target temperature during the preheating in the case of the image forming apparatus and fixing apparatus for performing the preheating. It is possible, by the above-mentioned temperature control of the fixing apparatus, to control the excessive temperature rising of the pressure roller in the starting step.

(Third Embodiment)

Hereafter, the temperature control in the starting step of the fixing apparatus on the start of printing according to a third embodiment will be described. The configurations of the image forming apparatus and the fixing apparatus are the same as those in the first embodiment.

Figure 16:
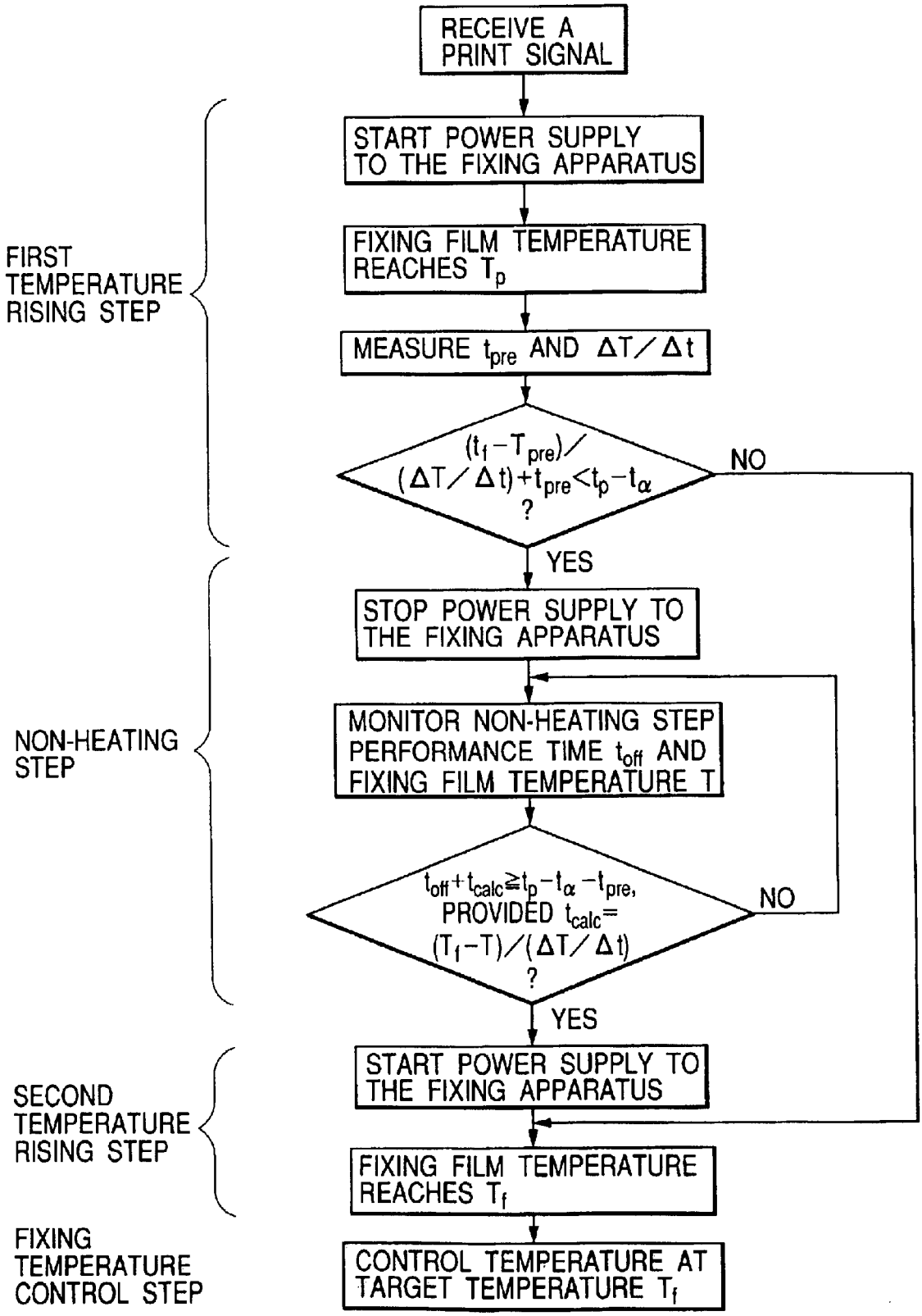
FIG. 16 is a temperature control flowchart according to the third embodiment.

FIG. 15 is a schematic view showing the fixing film temperature, setting of the target temperature of the temperature control and the timing of the recording material reaching the fixing apparatus in the starting step of the fixing apparatus according to this embodiment. FIG. 16 is a flowchart of the control sequence performed by the control circuit 200.

This embodiment is characterized by calculating the temperature rising time in the second temperature rising step by acquiring the temperature rising speed in the first temperature rising step. The temperature rising speed has the elements related to the temperature rise of the fixing apparatus such as the surrounding ambient temperature and input voltage reflected thereon.

First, after the receipt of the print signal, the first temperature rising step is implemented as in the first embodiment. In this embodiment, the target temperature in the first temperature rising step is set at a temperature $T_{pre}$ lower than the fixing temperature $T_f$. It is thereby possible to shorten the time for the first temperature rising step and to further control the temperature rise of the pressure roller.

After the fixing film temperature reaches $T_{pre}$, it measures time $t_{pre}$ required for the temperature to rise from a temperature $T_1$ at the start of the first temperature rising step to $T_{pre}$ and a temperature rising speed $\Delta T/\Delta t$. And it determines whether or not the non-heating step can be implemented based on the temperature rising time $t_{pre}$ and the temperature rising speed $\Delta T/\Delta t$ according to the equation described below.

In addition to the temperature rising time $t_{pre}$, if the time for implementing the non-heating step is $t_{off}$, the temperature rising time until the fixing temperature calculated based on the temperature rising speed $\Delta T/\Delta t$ is $t_{calc}$, and the spare time from starting the fixing temperature control step until the entry of the recording material into the fixing nip is $t\alpha$, the following relationship holds.

$$t_p = t_{pre} + t_{off} + t_{calc} + t\alpha \tag{4}$$

To implement the non-heating step, the following must be fulfilled from equation (4).

$$t_{off} = t_p - (t_{pre} + t_{calc} + t\alpha) > 0 \tag{5}$$

Considering that the fixing film temperature $T_{pre}$ when finishing the first temperature rising step is equal to the fixing film temperature $T_2$ when starting the second temperature rising step, $t_{calc}$ in the case of $t_{off}=0$ is represented as follows.

$$t_{calc} = (T_f - T_{pre})/(\Delta T/\Delta t) \tag{6}$$

To be more specific, it is possible to implement the non-heating step if the temperature rising speed $\Delta T/\Delta t$ and the temperature rising time $t_{pre}$ satisfy the following from equations (5) and (6).

$$(T_f - T_{pre})/(\Delta T/\Delta t) + t_{pre} < t_p - t\alpha \tag{7}$$

In the case where the temperature rising speed $\Delta T/\Delta t$ and the temperature rising time $t_{pre}$ cannot satisfy equation (7), the non-heating step is not implemented since there is no sufficient time before the entry of the recording material into the fixing nip. In this case, the target temperature is immediately switched from $T_{pre}$ to the fixing temperature $T_f$ to continue the rise in the temperature, and the fixing temperature control step is performed when it reaches the fixing temperature $T_f$.

In the case where the temperature rising speed $\Delta T/\Delta t$ and the temperature rising time $t_{pre}$ satisfy equation (7), the non-heating step is implemented after finishing the first temperature rising step. The time for the non-heating step $t_{off}$ is the time from the timing of finishing the first temperature rising step until the timing of starting the second temperature rising step mentioned later, and the length thereof is determined by the timing of starting the second temperature rising step. The timing of starting the second temperature rising step according to this embodiment is determined based on the temperature rising time $t_{pre}$ and the temperature rising speed $\Delta T/\Delta t$ in the first temperature rising step and the fixing film temperature T in the non-heating step.

The following relationship holds from equation (6) immediately before the non-heating step.

$$t_{calc} < t_p - t_{pre} - t\alpha \tag{8}$$

The following relationship holds immediately after starting the non-heating step considering that $t_{off}$ as a parameter to increase from 0 along with elapse of time for the non-heating step is added.

$$t_{off}+t_{calc}<t_p-t_{pre}-t\alpha \quad (9)$$

However, $t_{off}$ is 0 at this point in time.

Next, the change of $t_{off}$ and $t_{calc}$ during the implementation of the non-heating step is considered. As $t_{off}$ on the left side of equation (9) is the time for the non-heating step, it increases from 0 along with the elapse of time. In addition, if the fixing film temperature when finishing the non-heating step is T, $t_{calc}$ on the left side of equation (9) is calculated as follows.

$$t_{calc}=(T_f-T)/(\Delta T/\Delta t) \quad (10)$$

As the fixing film temperature T becomes lower than $T_{pre}$ along with the elapse of the time for the non-heating step, $t_{calc}$ increases from equation (10).

To be more specific, as the non-heating step proceeds, the left side of equation (9) comprised of the sum of the two terms of $t_{off}$ and $t_{calc}$ increases.

Thus, as for the timing of finishing the non-heating step, that is, the timing of starting the second temperature rising step, the change of the time for the non-heating step $t_{off}$ and the fixing film temperature T should be monitored, and it should be the timing wherein the two terms of $t_{off}$ and $t_{calc}$ satisfy the following equation for the first time.

$$t_{off}+t_{calc}\leq t_p-t_{pre}-t\alpha \quad (11)$$

If the fixing film temperature at this time is $T_2$, $t_{calc}$ may be represented as follows.

$$t_{calc}=(T_f-T_2)/(\Delta T/\Delta t) \quad (12)$$

After finishing the non-heating step, the second temperature rising step is implemented. The target temperature in the second temperature rising step is the fixing temperature $T_f$. The temperature rising time $t_{calc}$ calculated according to equation (12) is allotted to the second temperature rising step.

After finishing the second temperature rising step, the fixing temperature control step is implemented. In the fixing temperature control step, the spare time $t\alpha$ is provided from starting the fixing temperature control step until the entry of the recording material into the fixing nip. This time is utilized to have overshooting of the fixing film temperature after the rise in the temperature and so on converge so that the fixing film temperature is stabilized. And the fixing film is kept at the fixing temperature $T_f$, and after carrying the recording material to the fixing apparatus, the unfixed toner image on the recording material is fixed.

The above-mentioned temperature control of the fixing apparatus can control the excessive rise in the temperature of the pressure roller in the starting step. In addition, it is also possible to have the energy conservation effects such as the reduction in power consumption and the decreased temperature rise in the machine.

(Fourth Embodiment)

Hereafter, an embodiment of the present invention will be described along the drawings.

(Overall Configuration)

First, the overall configuration of the image forming apparatus will be described by referring to FIG. 17.

Figure 17:
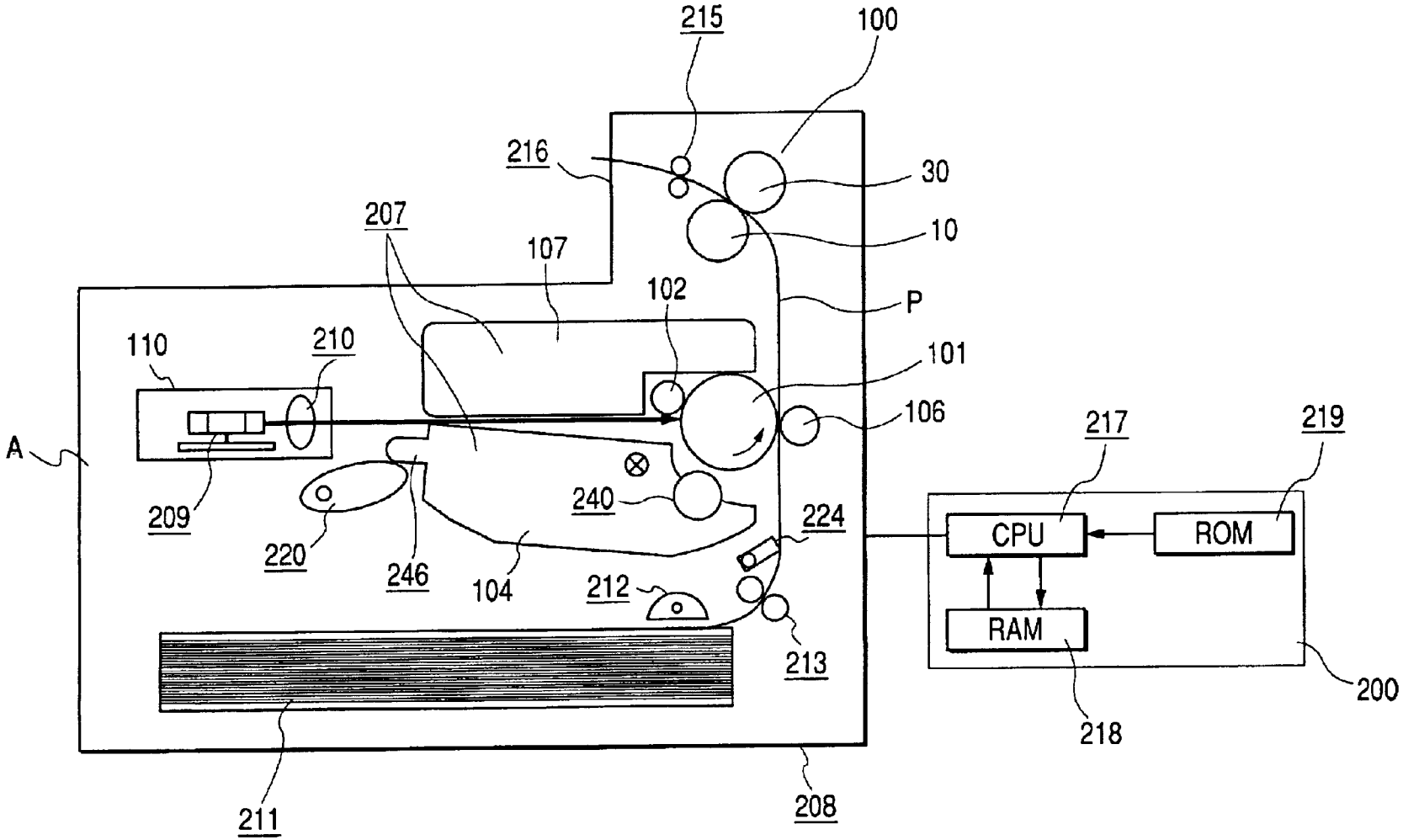
FIG. 17 is a longitudinal section showing a schematic configuration of the image forming apparatus according to the fourth embodiment.

FIG. 17 is a longitudinal section showing the overall configuration of a laser beam printer A as an embodiment of the image forming apparatus. The photosensitive drum 101 is driven by an unshown driving means to rotate in the direction of the arrow in the drawing. Surrounding the photosensitive drum 101, there are the devices placed such as the charging apparatus 102 for evenly charging the surface of the photosensitive drum 101 according to the direction of the rotation thereof, a scanner unit 110 for irradiating a laser beam based on image information to form the electrostatic latent image on the photosensitive drum 101, the developing apparatus 104 for sticking the toner on the electrostatic latent image and developing it as the toner image, the transferring roller 106 for transferring the toner image on the photosensitive drum 101 to the recording material P, and the cleaner 107 for removing the toner remaining on the surface of the photosensitive drum 101 after transferring.

Here, the photosensitive drum 101, charging apparatus 102, developing apparatus 104 and cleaner 107 are integrally rendered as a cartridge to form a process cartridge 207.

The scanner unit 110 is placed approximately in a horizontal direction of the photosensitive drum 101, and image light corresponding to an image signal by a laser diode (not shown) is irradiated on a polygon mirror 209 rotated at high speed by a scanner motor (not shown). It has a configuration wherein the image light reflected on the polygon mirror 209 selectively exposes the surface of the charged photosensitive drum 101 via an image formation lens 210 so as to form the electrostatic latent image.

As for the transferring roller 106 placed opposite the photosensitive drum 101, a metallic core covered with an elastic member such as EPDM (ethylene-propylene-diene ternary copolymer), urethane rubber or NBR (nitrile butadiene rubber) adjusted to volume resistivity of $10^7$ to $10^{11}$ Ω·cm or so may be used for instance. The transferring roller 106 has a bias of straight polarity applied thereto from an unshown power supply, and the toner image of negative polarity on the photosensitive drum 101 is transferred by an electric field due to this bias to the recording material P in contact with the photosensitive drum 101.

A paper feeding part 8 feeds and carries the recording material P to the image forming part, and has a plurality of sheets of the recording material P stored in a paper feeding cassette 211. When forming the image, a paper feeding roller 212 (half moon roller) and a pair of registration rollers 213 are driven to rotate according to the image forming operation, where one sheet of the recording material P in the paper feeding cassette 211 is separated and fed, and a tip of the recording material P bumps into the pair of registration rollers 213 and stops once, forms a loop and then is fed to the nip formed by the transferring roller 106 and the photosensitive drum 101. Reference numeral 224 denotes a registration sensor, and the image formation is performed with reference to the point in time when the recording material passes here.

The fixing apparatus 100 is a quick-start fixing apparatus of the electromagnetic induction heating method for fixing the toner image transferred to the recording material P, comprised of the cylindrical fixing film 10 as a rotating member having the heat generating layer (conductive magnetic member) and the pressure roller 30 in pressurized contact therewith for giving heat and pressure to the recording material P. To be more specific, the recording material P having the toner image on the photosensitive drum 101 transferred thereto is carried by the cylindrical fixing film 10 and the pressure roller 30 when passing through the fixing apparatus 100, and is also given the heat and pressure. Thus, the toner image of a plurality of colors is fixed on the surface of the recording material P. The fixed recording material P is ejected face down from an ejection part 216 to the outside of the apparatus proper by a pair of ejection rollers 215.

The control circuit 200 as control means controls the entire operation of the image forming apparatus A including the temperature control of the fixing apparatus, and has a CPU 217, an RAM (Random Access Memory) 218 and an ROM (Read Only Memory) 219. The ROM 219 has a program for controlling the image forming apparatus and various types of data written thereto, and the RAM 218 is used for purposes such as storing the data taken in for controlling the image forming apparatus.

(Process Cartridge)

Figure 18:
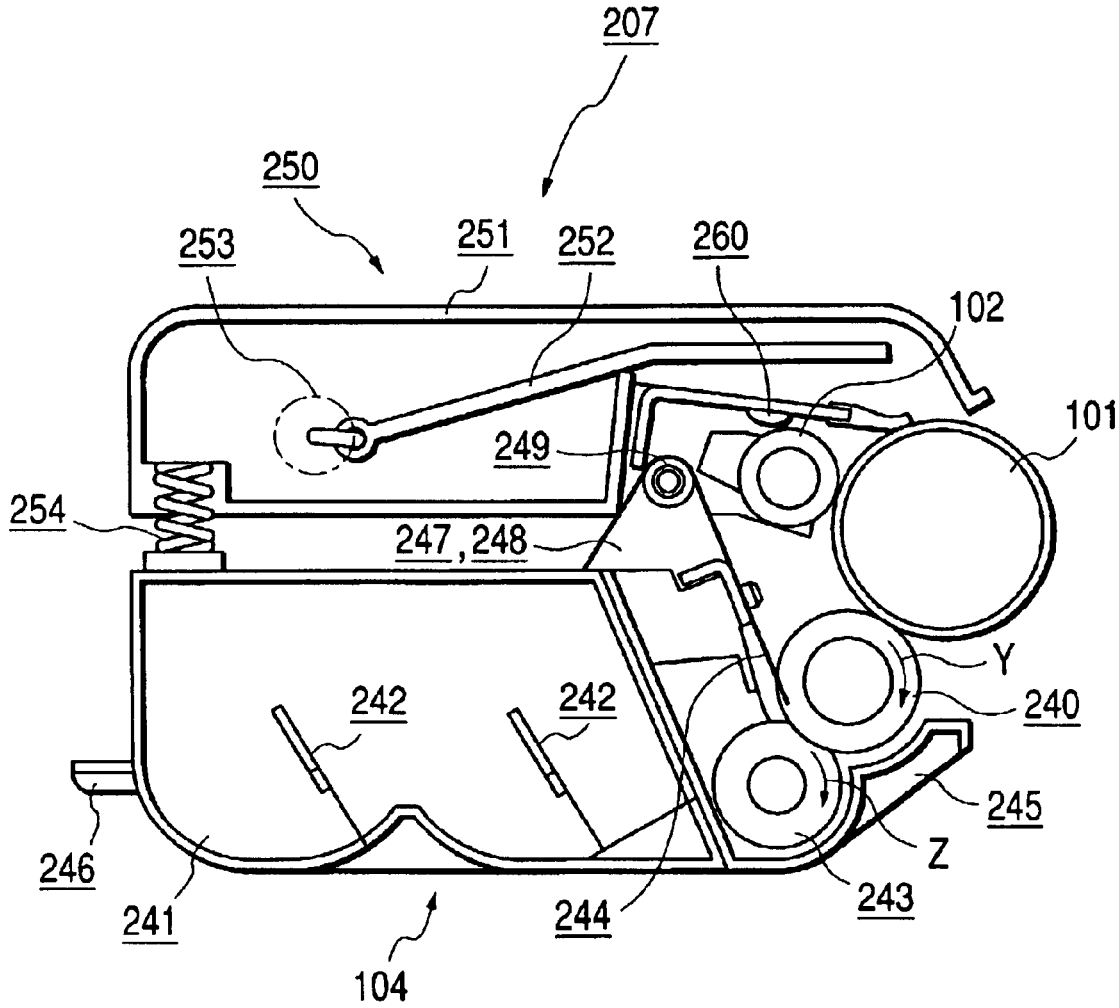
FIG. 18 is a longitudinal section showing a schematic configuration of a process cartridge according to the fourth embodiment.
Figure 19:
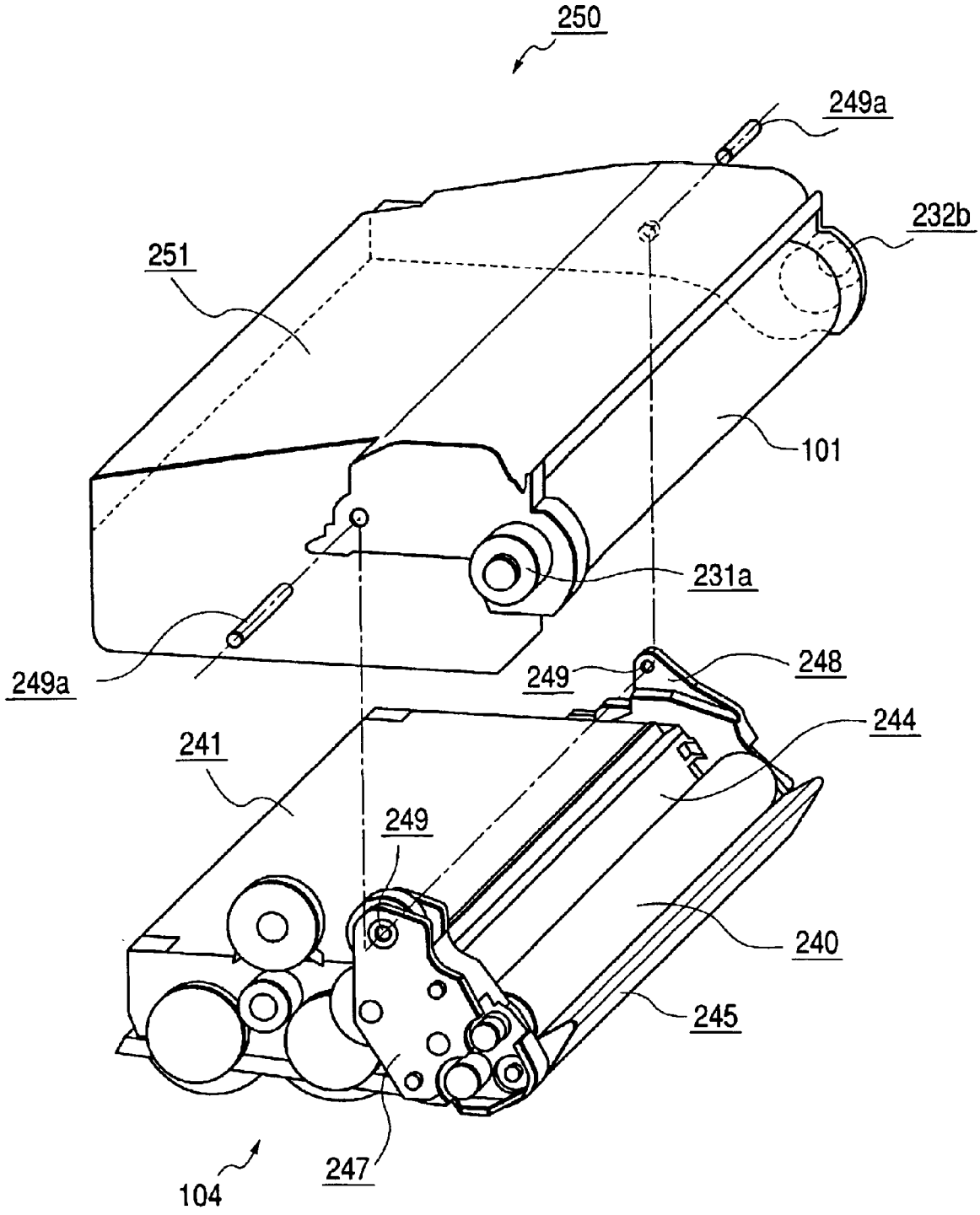
FIG. 19 is a perspective view showing the schematic configuration of the process cartridge according to the fourth embodiment.

A process cartridge will be described in detail by referring to FIGS. 18 and 19. FIGS. 18 and 19 show a main section and a perspective view of a process cartridge 207 storing the toner. The process cartridge 207 is divided into the photosensitive drum 101, a photosensitive drum unit 250 having charging means and cleaning means, and a developing unit 104 having developing means for developing the electrostatic latent image on the photosensitive drum 101. The photosensitive drum 101 is constituted, for instance, by applying an organic photoconductive layer (OPC photosensitive member) on a rim surface of an aluminum cylinder of 30 mm diameter.

The photosensitive drum unit 250 has the photosensitive drum 101 rotatably mounted on a cleaning frame body 251 via bearings 231 (231*a*, 231*b*). The photosensitive drum 101 has the charging apparatus 102 for uniformly charging the surface thereof and a cleaning blade 260 for removing the toner remaining thereon placed on the rim thereof, and furthermore, the remaining toner removed from the surface thereof by the cleaning blade 260 is sequentially sent by a toner feeding mechanism 252 to a waste toner room 253 provided behind the cleaning frame body. And the driving force of an unshown drive motor is conveyed to one end of the back shown in the drawing so as to rotate the photosensitive drum 101 counterclockwise as shown according to the image forming operation.

The developing unit 104 is comprised of a developing roller 240 for rotating in the direction of the arrow in contact with the photosensitive drum 101, a toner container 241 accommodating the toner and a developing frame body 245. The developing roller 240 is rotatably supported by the developing frame body 245 via a bearing member, and has a toner supplying roller 243 for rotating in the arrow Z direction in contact with the developing roller 240 and a developing blade 244 placed on the rim thereof respectively. Furthermore, the toner container 241 has a toner carriage mechanism 242 for stirring the accommodated toner and carrying it to the toner supplying roller 243 provided therein.

And the developing unit 104 has a hanging configuration wherein, centering on support axes 249 provided to bearing members 247, 248 mounted on both ends of the developing unit 104 respectively, the entire developing unit 104 is reciprocatively supported against the photosensitive drum unit 250 by a pin 249*a*, and when in a state of the process cartridge 207 alone (not mounted on the printer proper), the developing unit 104 is always energized by a pressure spring 254 so as to have the developing roller 240 contact the photosensitive drum 101 with angular moment centering on the support axes 249. Furthermore, the toner container 241 of the developing unit 104 has a rib 246 for, when creating clearance between the developing roller 240 and the photosensitive drum 101, being in contact with clearance means (described later) of the printer A proper integrally provided thereto.

(Fixing Apparatus)

Description of the fixing apparatus will be omitted since it has the same configuration as the fixing apparatus 100 used in the first embodiment.

(Drive Configuration)

Next, an operating mechanism when mounting the process cartridge 207 on the printer proper A will be described in detail.

As previously described, the process cartridge 207 always has the developing roller 240 in contact with the photosensitive drum 101 when in a state of the process cartridge 207 alone as in FIG. 18.

On the other hand, a cam 220 is placed on the deeper side in the inserting direction of the process cartridge 207 of the printer proper A, for the purpose of creating clearance between the developing roller 240 and the photosensitive drum 101 against energization of the developing unit 104. The cam 220 is rotated by an unshown driving means, and lifts the rib 246 so that the developing roller 240 creates clearance from the photosensitive drum 101 or releases the lifting of the rib 246 so that the developing roller 240 contacts the photosensitive drum 101. Normally, if the process cartridge is mounted on the printer proper, the cam 220 lifts the rib 246 so that the developing roller 240 creates clearance from the photosensitive drum 101. Accordingly, even in the case where it is not used for a long time with the process cartridge 207 mounted, the developing roller 240 always keeps the clearance from the photosensitive drum 101, and so it is possible to securely prevent permanent deformation of a roller layer caused by keeping the developing roller 240 in contact with the photosensitive drum 101 for a long period of time. The photosensitive drum 101 and the developing roller 240 of the process cartridge 207 mounted on the image forming apparatus proper A can be separately driven by unshown motors.

(Printing Operation)

Figure 20:
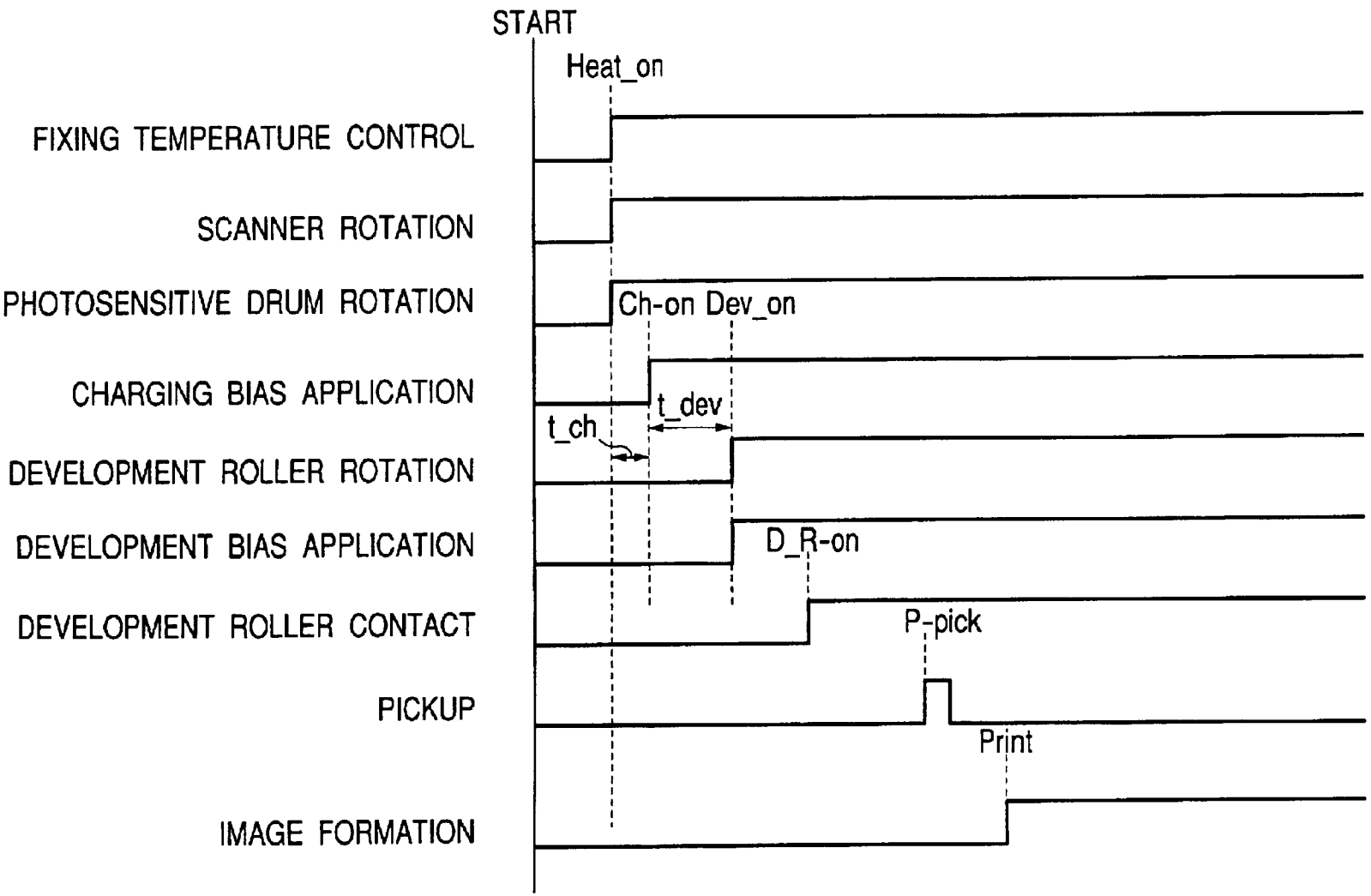
FIG. 20 is a timing chart representing operation of the image forming apparatus according to the fourth embodiment.
Figure 21:
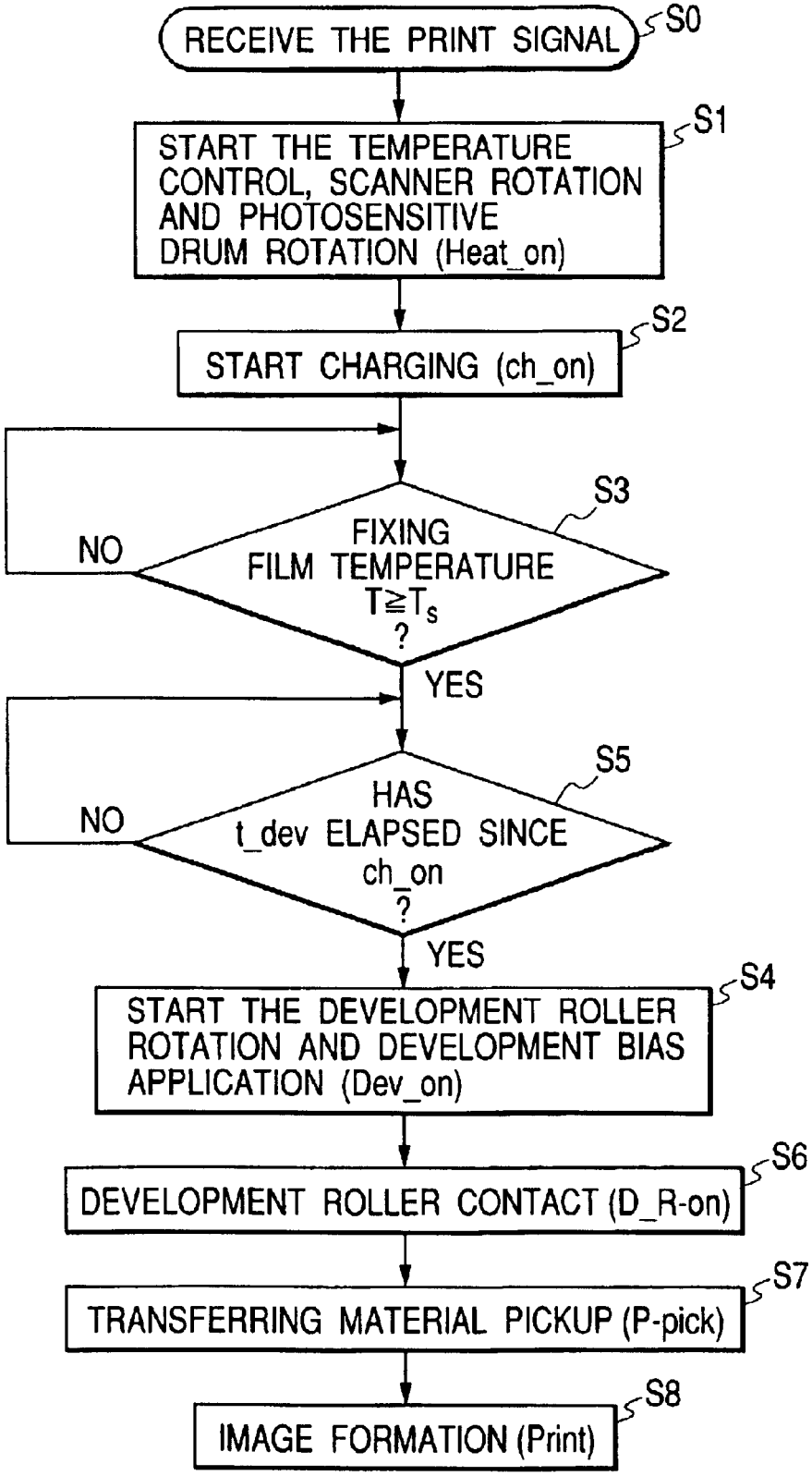
FIG. 21 is a flowchart representing the operation of the image forming apparatus according to the fourth embodiment.

The image forming operation according to this embodiment will be described by using the schematic view of FIG. 17, the timing chart of FIG. 20 and the flowchart of FIG. 21.

If the printing operation is started by inputting the print signal to the image forming apparatus proper (Start, S0), the CPU 217 first starts the temperature control of the fixing apparatus 100, rotation of the photosensitive drum 101 and rotation of the scanner 110 (Heat-on, S1). The developing roller 240 remains stopped at this time. Next, it starts application of the charging bias when predetermined time t_ch elapses after the photosensitive drum 101 started the rotation (Ch-on, S2). It is because there is a possibility of creating a memory on the photosensitive drum if the rotation of the photosensitive drum and application of the charging bias are performed at the same time.

Next, the CPU 217 determines whether or not the temperature T of the fixing apparatus 100 has reached a predetermined temperature Ts (S3). The predetermined temperature Ts is the temperature wherein continuing the temperature control as-is is expected to allow the temperature of the fixing apparatus 100 to reach the fixing temperature $T_f$ before the recording material P reaches the fixing apparatus 100 even when the image forming apparatus is under a low temperature environment or when supplied power supply voltage is a lower limit value. Hereafter, the predetermined temperature Ts is called an assured risen temperature. As a matter of course, the assured risen temperature Ts is set to be lower than the fixing temperature $T_f$.

If the temperature T of the fixing apparatus 100 reached the assured risen temperature Ts, it starts the rotation of the developing roller 240 and application of a development bias when the predetermined time t_dev elapses after the start of the application of the charging bias (Ch-on) (Dev-on, S4). At this time, if the temperature T of the fixing apparatus has not reached the assured risen temperature Ts, it continues to monitor the temperature of the fixing apparatus 100, and if Ts has been reached within t_dev, it waits until reaching t_dev (S5), and then starts the rotation of the developing roller 240 and application of the development bias.

If the temperature reaches the assured risen temperature Ts past t_dev, it starts the rotation of the developing roller 240 and application of the development bias at the time of reaching Ts. To be more specific, it delays the timing of the rotation of the developing roller 240 and application of the development bias to be past t_dev so as to protract the temperature rising time of the fixing apparatus.

Normally, if there is a sufficient distance of clearance between the photosensitive drum 101 and the developing roller 240 so that the developing roller 240 keeps the clearance, there is no possibility of the toner flying from the developing roller 240 to the photosensitive drum 101 even if the surface of the photosensitive drum 101 is not properly charged. However, it starts the rotation of the developing roller 240 and application of the development bias after the time t_dev when the photosensitive drum 101 is charged and becomes a normal electric potential in order to prevent the toner from flying even in the case where the distance of clearance becomes shorter for some reason. Accordingly, even if the temperature T of the fixing apparatus has already reached the assured risen temperature Ts within t_dev, it does not perform the rotation of the developing roller 240 and application of the development bias until t_dev, so that the printing operation of starting the rotation of the developing roller 240 and application of the development bias at the time of t_dev is the shortest printing time.

After t_dev, the developing roller 240 is put in contact with the photosensitive drum 101 with reference to Dev_on after the predetermined time (D_R-on, S6), and then the recording material P is picked up (P-pick, S7) so as to form the image (Print, S8).

In the case where a temperature rising state of the fixing apparatus is determined after picking up the recording material, there is a possibility of lowering printing accuracy when only extension of the temperature rising time of the fixing apparatus is performed by stopping the image forming operation once based on a determination that the temperature rising state thereof is insufficient. Therefore, the temperature rising state must be determined before picking up the recording material. In the case where it is determined immediately before picking the recording material up, however, the rotations of the photosensitive drum and the developing roller have already started, and if the pickup operation is to be held on standby until the fixing apparatus reaches the predetermined temperature because the temperature rising state thereof is insufficient, it means that the photosensitive drum and the developing roller keep on rotating during that time. As the life of the developing device is significantly affected by the number of rotations of the developing roller, it is desirable to keep that number at a necessary minimum. On the other hand, a surface potential of the photosensitive drum once charged does not attenuate unless a transferring bias is applied or exposure is performed, and so a discharge for charging does not continue to occur if only the charging bias is applied and it is rotating. Accordingly, there is no fear that the surface of the photosensitive drum is cut away and its life becomes shorter due to the discharge.

Thus, it is possible, by controlling the timing of the start of rotation of the developing roller 240 and application of the development bias according to the temperature rising state of the fixing apparatus 100 as in this embodiment, to securely increase the temperature of the fixing apparatus without shortening the life of the developing device even when the image forming apparatus is under the low temperature environment or when the supplied power supply voltage is reduced to the lower limit value.

(Temperature Control Operation)

Figure 22:
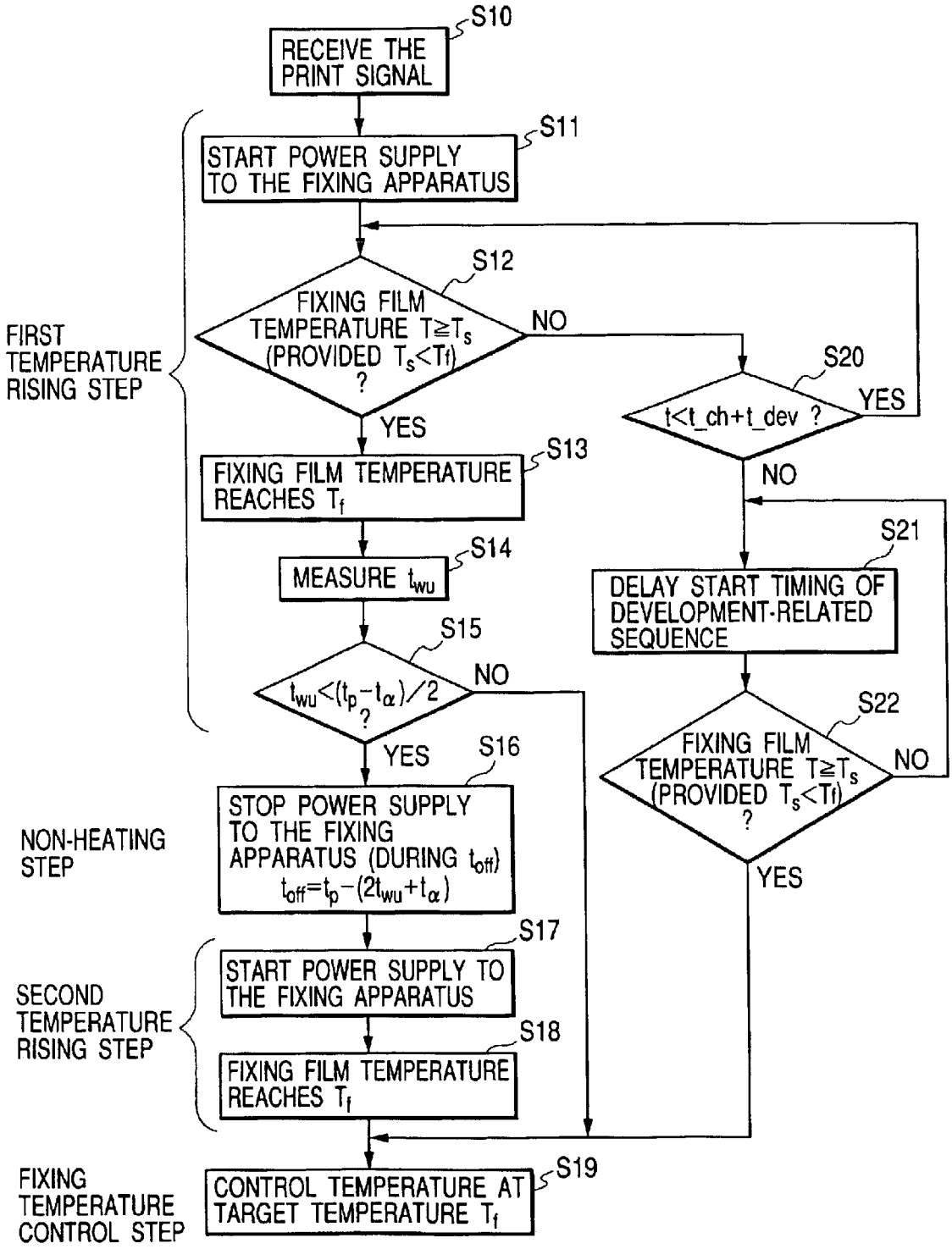
FIG. 22 is a temperature control flowchart according to the fourth embodiment.
Figure 23:
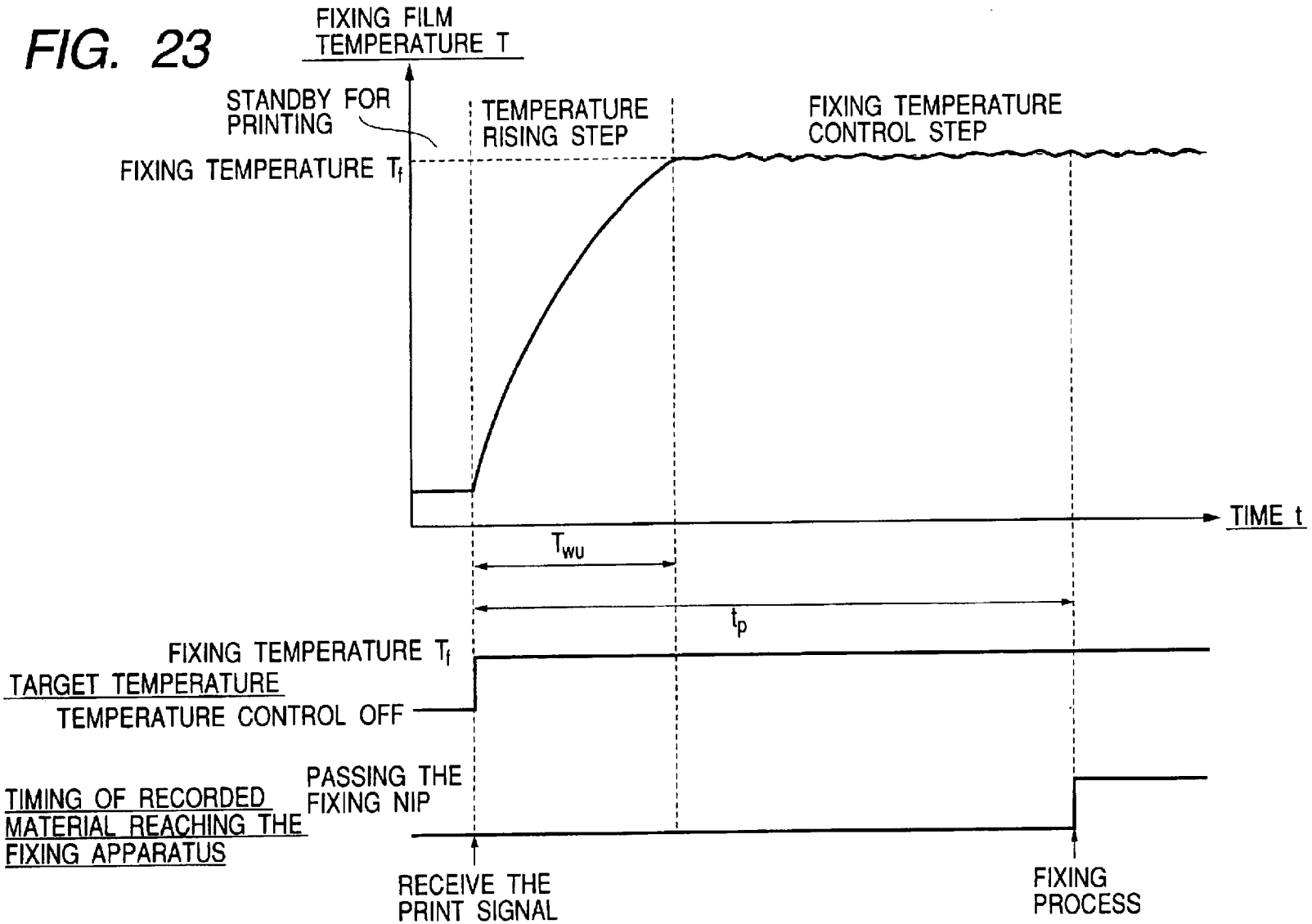
FIG. 23 is a schematic view showing the temperature control in the starting step of the fixing apparatus according to a past example.

Hereafter, the temperature control in the starting step of the fixing apparatus on the start of the printing in the fourth embodiment will be described. FIG. 22 is a flowchart of the control sequence performed by the control circuit 200.

After the receipt of the print signal (S10), the image forming apparatus performs the power supply to the fixing apparatus (S11), and starts the first temperature rising step. As for the timing of starting the first temperature rising step, it may be implemented after the receipt of the print signal, and is not limited to implementing it at the same time as the start of the image forming operation. The fixing apparatus starts to increase the temperature aiming at the target temperature, and in this embodiment, the target temperature of the first temperature rising step is the fixing temperature $T_f$ to be used when fixing the toner on the recording material.

Next, it is checked whether or not the fixing film temperature T has reached the assured risen temperature $T_s$ (<fixing temperature $T_f$) described in the section "Printing Operation" (S12).

In the case where the fixing film temperature T is lower than the assured risen temperature $T_s$, it is checked whether or not temperature rising time t from the start of the power supply at the fixing film temperature T is shorter than t_ch+t_dev (S20). t_ch+t_dev is the shortest time from the start of the power supply to the fixing apparatus to the timing of the rotation of the developing roller and application of the development bias.

In the case where the temperature rising time t exceeds t_ch+t_dev, as described in the section "Printing Operation", the temperature rising time of the fixing apparatus is extended until the fixing film temperature T reaches the assured risen temperature $T_s$ by delaying operation timing of development-related sequences such as the rotation of the developing roller and application of the development bias (S21, 22). To be more specific, the control exerted here extends the temperature rising time by delaying the sequences related to the image formation during the time until the fixing apparatus reaches the assured risen temperature Ts in the case where it is determined that the temperature rising of the fixing apparatus is slow. The case where the temperature rising time t exceeds t_ch+t_dev is a situation where the rise in the temperature of the fixing apparatus cannot be in time for the fixing process of the recording material unless the operation timing of the development-related sequences is delayed as described in the section "Printing Operation", and so it is not possible, as a matter of course, to secure the time for performing the non-heating step as mentioned in the first embodiment. Thus, according to this embodiment, it does not proceed to the steps (S13 to 18) of determining the implementation of the non-heating step in this case, but it increases the fixing temperature $T_f$ as the target temperature as-is so as to prepare for the fixing process of the recording material (S19).

In the case where the fixing film temperature T reaches $T_s$ in a state where the temperature rising time t is t_ch+t_dev or lower, it is increased as-is targeting the fixing temperature $T_f$ (S13). Thereafter, it proceeds to the step of determining whether or not the non-heating step can be implemented, but the operation thereafter (S13 to 18) including this step is the same as the starting step described in the first embodiment and so the description thereof will be omitted. In addition, the operation thereafter is not limited to the temperature control of the starting step described in the first embodiment, but it may also be the temperature control of the second or third embodiment.

Moreover, it was described that it does not proceed to the steps (S13 to 18) of determining the implementation of the non-heating step in the case where the temperature rising time t exceeds t_ch+t_dev. However, even if it proceeds to the steps of determining the implementation of the non-heating step, the non-heating step will hardly be implemented because the time $t_{wu}$ for increasing the temperature to the fixing temperature $T_f$ is longer than usual. Thus, in the case where the temperature rising time t exceeds t_ch+t_dev, it may proceed to the steps of determining the implementation of the non-heating step.

As described above, it is possible, by performing adequate printing operation and temperature control operation according to the temperature rising speed of the fixing apparatus, to constantly and stably supply the fixed image of high quality even if environmental conditions under which the image forming apparatus and the fixing apparatus are placed change and the temperature rising speed of the fixing apparatus changes.

Moreover, the image forming apparatus related to the present invention is not limited to the above-mentioned embodiments, but it is changeable in various ways within the outline thereof. To be more specific, while the photosensitive drum and the developing roller of the process cartridge were driven by separate motors in the above embodiments, it is also possible to use a method of dividing the drive by utilizing a gear and a clutch from one motor. In addition, another method such as using the cam instead of the clearance plate may also be used. Moreover, the timing of starting the fixing apparatus, photosensitive drum and scanner and the timing of contacting the developing roller and picking up the recording material may be different from the above order. While the scanner of an image scanning method was used in the above embodiments, it is of course possible to use an exposure apparatus employing an LED array. In that case, the starting operation as that of the scanner is not required, and so the timing of starting is different from that of the scanner. Furthermore, the present invention is also applicable to a color image forming apparatus having a plurality of photosensitive drums and development mechanisms.

<Others>

1) Although the apparatus of the film heating method using the electromagnetic induction heating method is adopted as the fixing apparatus in the embodiments, the fixing apparatus according to the present invention is not limited thereto. It may also be the apparatus of the film heating method using a ceramic heater as the heat generating means. It may also be the apparatus of the heat roller method.

2) There is no restriction as to a formation principle/process of the unfixed toner image against the recording material of the image forming apparatus, and it is arbitrary. It may be either a transferring method or a direct method.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising:

image forming means for forming an unfixed toner image on a recording material;

heating and fixing means for heating and fixing said unfixed toner image on the recording material;

a temperature sensing element for sensing the temperature of said heating and fixing means; and power controlling means for controlling power supplied to said heating and fixing means so that said heating and fixing means keeps a fixable temperature at least on fixing operation based on an output from said temperature sensing element, wherein said power controlling means controls power supply to said heating and fixing means based on said output from the temperature sensing element after supplying power to said heating and fixing means in response to a print signal, so that, in the case where the temperature of said heating and fixing means rises fast, a temperature control operation for keeping the fixable temperature should not be protracted before heating and fixing.

2. The image forming apparatus according to claim 1, wherein said power controlling means temporarily performs a low temperature control step for controlling the heating and fixing means at a temperature lower than the fixable temperature or a non-heating step for heating no heating and fixing means after the print signal, in the case where the temperature of said heating and fixing means rises fast.

3. The image forming apparatus according to claim 2, wherein sandwiching said low temperature control step or said non-heating step is performed after of the print signal before rendering a target temperature as the fixable temperature.

4. The image forming apparatus according to claim 3, wherein said power controlling means determines performance time of said low temperature control step or said non-heating step based on said output from the temperature sensing element after supplying the power to said heating and fixing means in response to the print signal.

5. The image forming apparatus according to claim 4, wherein the temperature of said heating and fixing means is increased once to the fixable temperature or a lower temperature than that by supplying the power to said heating and fixing means in response to the print signal.

6. The image forming apparatus according to claim 1, wherein said heating and fixing means is comprised of a rotating heating member capable of rotation and heating the recording material, a rotating pressure member for forming a nip therewith to heat and pressurize the recording material, and heat generating means for increasing the temperature of said rotating heating member.

7. The image forming apparatus according to claim 6, wherein said rotating heating member is a cylindrical film.

8. The image forming apparatus according to claim 6, wherein said rotating heating member is driven by being slaved to the rotating pressure member.

9. The image forming apparatus according to claim 6, wherein said rotating heating member comprises a conductive member, and the heat generating means for heating said rotating heating member is magnetic filed generating means including an exciting coil, which has an alternating magnetic field from said magnetic field generating means act upon said conductive member to generate an eddy current so as to cause said rotating heating member to generate heat.

10. The image forming apparatus according to claim 1, wherein it has a first sequence group for sequentially operating at least following the print signal by the image forming apparatus, and a second sequence group for determining timing of starting the operation according to a sensed temperature of the fixing apparatus after a predetermined time from the receipt of the print signal by the image forming apparatus.

11. The image forming apparatus according to claim 10, wherein said first sequence group at least includes control related to the temperature control of the heating and fixing means.

12. The image forming apparatus according to claim 10, wherein said second sequence group includes control related to rotation of a development roller, the rotation of a photosensitive drum or application of a charging bias.

13. The image forming apparatus according to claim 10, wherein after said second sequence group starts the operation, said first sequence group operates by rendering criteria of said second sequence group as their new criteria.

14. The image forming apparatus according to claim 10, wherein said image forming means is a color image forming apparatus for forming an image by performing charging, exposure and development more than once.

15. A fixing apparatus for heating and fixing the an unfixed toner image on a recording material introduced from image forming means, comprising:

a heating member for heating by receiving power supply;

temperature sensing element for sensing a temperature of said fixing apparatus; and power controlling means for controlling power supplied to said heating member so that said fixing apparatus keeps a fixable temperature at least on fixing operation based on an output from said temperature sensing element, wherein said power controlling means controls the power supply to the heating member based on said output from the temperature sensing element after supplying power to said heating and fixing means in response to a print request so that, in the case where the temperature of said fixing apparatus rises fast, a temperature control operation for keeping a fixable temperature should not be protracted before the heating and fixing.

16. The fixing apparatus according to claim 15, wherein said power controlling means controls the power supply to the heating member by temporarily performing a low temperature control step for controlling the temperature of the fixing apparatus at a temperature lower than the fixable temperature or a non-heating step for heating no heating and fixing means the print request, in the case where the temperature of said heating and fixing means rises fast.

17. The fixing apparatus according to claim 16, wherein said low temperature control step or said non-heating step is performed after the print request before rendering a target temperature as the fixable temperature.

18. The fixing apparatus according to claim 17, wherein said power controlling means determines performance time of said low temperature control step or said non-heating step based on said output from the temperature sensing element after supplying the power to said heating member in response to the print request.

19. The fixing apparatus according to claim 18, wherein the temperature of said fixing apparatus is increased once to the fixable temperature or a lower temperature than that by supplying the power to said heating member in response to the print request.

20. The fixing apparatus according to claim 15, wherein the fixing apparatus is comprised of a rotating heating member capable of rotation and heating the recording material, a rotating pressure member for forming a nip therewith to heat and pressurize the recording material, and a heat generating means for increasing the temperature of said rotating heating member.

21. The fixing apparatus according to claim 20, wherein said rotating heating member is a cylindrical film.

22. The fixing apparatus according to claim 20, wherein said rotating heating member is driven by being slaved to the rotating pressure member.

23. The fixing apparatus according to claim 20, wherein said rotating heating member comprises a conductive member, and said heat generating means is magnetic field generating means including an exciting coil, which has the alternating magnetic field from said magnetic field generating means act upon said conductive member to generate the eddy current so as to cause said rotating heating member to generate heat.

24. An image forming apparatus comprising:

an image forming unit for forming an unfixed toner image on a recording material;

heating and fixing unit for heating and fixing said unfixed toner image on the recording material;

a temperature sensing element for sensing the temperature of said heating and fixing means; and a power controller for controlling power supplied to said heating and fixing unit so that said heating and fixing unit keeps a fixable temperature at least on fixing operation based on an output from said temperature sensing element, wherein said power controller controls power supply to said heating and fixing unit based on the output from the temperature sensing element after supplying power to said heating and fixing unit in response to a print signal, so that, in the case where the temperature of said heating and fixing unit rises fast, a temperature control operation for keeping the fixable temperature should not be protracted before heating and fixing.

25. The image forming apparatus according to claim 24, wherein said power controller temporarily performs a low temperature control step for controlling the heating and fixing unit at a temperature lower than the fixable temperature or a non-heating step for heating no heating and fixing unit after the print signal, in the case where the temperature of said heating and fixing unit rises fast.

26. The image forming apparatus according to claim 25, wherein sandwiching said low temperature control step or said non-heating step is performed after the print signal before rendering a target temperature as the fixable temperature.

27. The image forming apparatus according to claim 26, wherein said power controller determines performance time of said low temperature control step or said non-heating step based on said output from the temperature sensing element after supplying the power to said heating and fixing unit in response to the print signal.

28. The image forming apparatus according to claim 27, wherein the temperature of said heating and fixing unit is increased once to the fixable temperature or a lower temperature than that by supplying the power to said heating and fixing unit in response to the print signal.

29. The image forming apparatus according to claim 24, wherein said heating and fixing unit is comprised of a rotating heating member capable of rotation and heating the recording material, a rotating pressure member for forming a nip therewith to heat and pressurize the recording material, and a heat generator for increasing the temperature of said rotating heating member.

30. The image forming apparatus according to claim 29, wherein said rotating heating member is a cylindrical film.

31. The image forming apparatus according to claim 29, wherein said rotating heating member is driven by being slaved to the rotating pressure member.

32. The image forming apparatus according to claim 29, wherein said rotating heating member comprises a conductive member, and the heat generator for heating said rotating heating member is a magnetic filed generator including an exciting coil, which has an alternating magnetic field from said magnetic field generator act upon said conductive member to generate an eddy current so as to cause said rotating heating member to generate heat.

33. An image forming apparatus comprising:

image forming means for forming an unfixed toner image on a recording material;

fixing means for heat-fixing said unfixed toner image on the recording material;

a temperature sensing element for sensing a temperature of said fixing means; and power controlling means for controlling power supplied to said fixing means so that said fixing means keeps a fixable temperature at least on fixing operation based on an output from said temperature sensing element, wherein said power controlling means has a frist mode in which in response to a print signal, said power controlling means monotonically increases the temperature of said fixing means to the fixable temperature and keeps the fixable temperature for the fixing operation, and a second mode in which after receiving a print signal and before the fixing operation, said power controlling means temporarily decreases the temperature of said fixing means.

34. The image forming apparatus according to claim 33, wherein said power controlling means temporarily performs a low temperature control step for controlling the fixing means at a temperature lower than the fixable temerature or a non-heating step for not heating the fixing means after the print signal in the second mode.

35. The image forming apparatus according to claim 34, wherein said power controlling means determines performance time of said low temperature control step or said non-heating step based on said output from the temperature sensing element after supplyiing the power to said fixing means in response to the print signal.

36. The image forming apparatus according to claim 35, wherein the temperature of said heating and fixing means is increased once to the fixable temperature or a lower temperature than that by supplying the power to said heating and fixing means in response to the print signal.

37. The image forming apparatus according to claim 33, wherein said fixing means is comprised of a rotating heating member capable of rotation and heating the recording material, a rotating pressure member for forming a nip therewith to heat and pressurize the recording material, and heat generating means for increasing the temperature of said rotating heating member.

38. The image forming apparatus according to claim 37, wherein said rotating heating member is a cylindrical film.

39. The image forming apparatus according to claim 37, wherein said rotating heating member is driven by being slaved to the rotating pressure member.

40. The image forming apparatus according to claim 37, wherein said rotating heating member comprises a conductive member, and the heat generating means for heating said rotating heating member is magnetic field generating means including an exciting coil, which has an alternating magnetic field from said magnetic field generating means act upon conductive member to generate an eddy current so as to cause said rotating heating member to generate heat.

41. An image forming apparatus comprising:

an image forming unit for forming an unfixed toner image on a recording material;

a heat fixing unit for heat-fixing the unfixed toner image on the recording material;

a temperature sensing element for sensing a temperature of said heat fixing unit; and a power controller for controlling power supplied to said heat fixing unit so that said heat fixing unit keeps a fixable temperature at least on fixing operation based on an output from said temperature sensing element, wherein said power controller has a first mode in which in response to a print signal, said power controller monotonically increases the temperature of said heat fixing unit to the fixable temperature and keeps the fixable temperature for the fixing operation, and a second mode in which after receiving a print signal and before the fixing operation, said power controller temporarily decreases the temperature of said heat fixing unit.

42. The image forming apparatus according to claim 41, wherein said power controller temporarily performs a low temperature control step for controlling the heat fixing unit at a temperature lower than the fixable temperature or a non-heating step for not heating the heat fixing unit after the print signal in the second mode.

43. The image forming apparatus according to claim 42, wherein said power controller determines performance time of the low temperature control step or the non-heating step based on said output from the temperature sensing element after supplying the power to said heat fixing unit in response to the print signal.

44. The image forming apparatus according to claim 43, wherein the temperature of said heat fixing unit is increased once to the fixable temperature or a lower temperature than that by supplying the power to said heat fixing unite in response to the print signal.

45. The image forming apparatus according to claim 41, wherein said heat fixing unit is comprised of a rotating heating member capable of rotation and heating the recording material, a rotating pressure member for forming a nip therewith to heat and pressurize the recording material, and a heater for increasing the temperature of said rotating heating member.

46. The image forming apparatus according to claim 45, wherein said rotating heating member is a cylindrical film.

47. The image forming apparatus according to claim 45, wherein said rotating heating member is driven by being slaved to the rotating pressure member.

48. The image forming apparatus according to claim 45, wherein said rotating heating member comprises a conductive member, and the heater for heating said rotating heating member includes an exciting coil, which has an alternating magnetic field act upon said conductive member to generate an eddy current so as to cause said rotating heating member to generate heat.

49. An image forming apparatus comprising:

an image forming unit adapted to form a toner image on a recording material;

a fixing unit having a heating member and adapted to heat the recording material to fix the toner image on the recording material; and a controller adapted to control power supplied to said heating member to perform a first step of increasing a temperature of said fixing unit in response to a print signal and a second step of keeping the temperature of said fixing unit at a predetermined fixing temperature, wherein said controller controls the power supplied to said heating member to perform a third step prior to said second step in accordance with information about an increase of the temperature in said first step, and the temperature of said fixing unit in said third step is lower than said predetermined fixing temperature.

50. An image forming apparatus according to claim 49, wherein when said information satisfies a predetermined condition, said controller performs said third step, and when said information does not satisfy the predetermined condition, said controller does not perform the third step.

51. An image forming apparatus according to claim 50, wherein performance time of said third step varies in accordance with said information.

52. An image forming apparatus according to claim 51, wherein in said third step, said controller does not supply the power to said heating member.

53. An image forming apparatus according to claim 51, wherein in said third step, said controller controls the power supplied to said heating member to keep the temperature of said fixing unit at a temperature lower than said predetermined fixing temperature.

54. An image forming apparatus according to claim 50, wherein in said third step, said controller does not supply the power to said heating member.

55. An image forming apparatus according to claim 50, wherein in said third step, said controller controls the power supplied to said heating member to keep the temperature of said fixing unit at a temperature lower than said predetermined fixing temperature.

56. An image forming apparatus according to claim 49, wherein in said third step, said controller does not supply the power to said heating member.

57. An image forming apparatus according to claim 49, wherein in said third step, said controller controls the power supplied to said heating member to keep the temperature of said fixing unit at a temperature lower than said predetermined fixing temperature.

58. An image forming apparatus according to claim 49, wherein in said first step, said controller controls the power supplied to said heating member to increase the temperature of said fixing unit to said predetermined fixing temperature.

59. An image forming apparatus according to claim 49, wherein in said first step, said controller controls the power supplied to said heating member to increase the temperature of said fixing unit to a temperature lower than the predetermined fixing temperature.

* * * * *

UNITED STATES PATENT AND TRADEMARK OFFICE

CERTIFICATE OF CORRECTION

PATENT NO. : 6,925,271 B2
DATED : August 2, 2005
INVENTOR(S) : Masahiro Suzuki et al.

It is certified that error appears in the above-identified patent and that said Letters Patent is hereby corrected as shown below:

Column 1,
Line 8, “in” should be deleted.

Column 2,
Line 35, “stating” should read -- starting --.

Column 7,
Line 24, “an” should read -- a --.

Column 15,
Line 56, “are” should read -- is --.

Column 16,
Line 43, “$t_{mv}$” should read -- $t_{wu}$ --.

Column 20,
Line 48, “stops once, forms” should read -- first stops, then forms --.

Column 26,
Line 31, “of” should be deleted.
Line 60, “filed” should read -- field --.

Column 27,
Line 46, “and” should read -- member --.
Line 47, “fixing means” should read -- after --.
Line 48, “heating and fixing means” should read -- fixing apparatus --.

UNITED STATES PATENT AND TRADEMARK OFFICE

CERTIFICATE OF CORRECTION

PATENT NO. : 6,925,271 B2
DATED : August 2, 2005
INVENTOR(S) : Masahiro Suzuki et al.

It is certified that error appears in the above-identified patent and that said Letters Patent is hereby corrected as shown below:

Column 29,
Line 7, “filed” should read -- field --.
Line 24, “frist” should read -- first --.

Signed and Sealed this

Twenty-ninth Day of November, 2005

JON W. DUDAS
*Director of the United States Patent and Trademark Office*